US008002632B2

(12) United States Patent
Okada

(10) Patent No.: US 8,002,632 B2
(45) **Date of Patent: *Aug. 23, 2011**

(54) GAME SERVER, GAME MACHINE, AND GAME CONTROL METHOD

(75) Inventor: Kazuo Okada, Koutou-ku (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/183,804

(22) Filed: Jul. 31, 2008

(65) Prior Publication Data

US 2009/0029764 A1 Jan. 29, 2009

Related U.S. Application Data

(63) Continuation of application No. 10/261,769, filed on Oct. 2, 2002, now Pat. No. 7,465,232.

(30) Foreign Application Priority Data

Oct. 2, 2001 (JP) ..... 2001-306774

(51) Int. Cl.
*A63F 9/24* (2006.01)

(52) U.S. Cl. ..... 463/25; 463/42

(58) Field of Classification Search ..... 463/25, 463/42

See application file for complete search history.

(56) References Cited

U.S. PATENT DOCUMENTS 4,283,709 A 8/1981 Lucero et al.
4,624,459 A 11/1986 Kaufman
4,652,998 A 3/1987 Koza et al.
4,657,256 A 4/1987 Okada
4,669,731 A 6/1987 Clarke
4,718,672 A 1/1988 Okada
4,775,937 A 10/1988 Bell
4,837,728 A * 6/1989 Barrie et al. ..... 463/27
4,964,638 A * 10/1990 Ishida ..... 463/27
4,993,713 A 2/1991 Harada
5,010,995 A 4/1991 Okada
5,178,390 A 1/1993 Okada
5,229,764 A 7/1993 Matchett et al.
5,280,909 A 1/1994 Tracy (Continued)

FOREIGN PATENT DOCUMENTS

DE 3242890 A1 5/1984

(Continued)

OTHER PUBLICATIONS

U.S. Appl. No. 11/734,834, filed Apr. 13, 2007, Okada.

(Continued)

*Primary Examiner* — Melba Bumgarner
*Assistant Examiner* — Tramar Harper
(74) *Attorney, Agent, or Firm* — Oblon, Spivak, McClelland, Maier & Neustadt, L.L.P.

(57) ABSTRACT

In a collective control of plural game machines placed in the same parlor, it is detected whether there is player change on each game machine and, based on the detection result, the credit cumulative consumption on each game machine is managed player by player. When the credit cumulative consumption of a certain player reaches a predetermined upper limit, payout return is executed to this player. The display status and non-display status of information about the upper limit can be switched depending on the play status. Therefore, the player can perform a game without anxiety while enjoying amusement of the game. As the result, the problem of missing customers is eliminated.

17 Claims, 14 Drawing Sheets

U.S. PATENT DOCUMENTS

| | | | | |
|---|---|---|---|---|
| 5,429,361 | A | 7/1995 | Raven et al. | |
| 5,564,700 | A | 10/1996 | Celona | |
| 5,611,730 | A * | 3/1997 | Weiss | 463/20 |
| 5,639,088 | A | 6/1997 | Schneider et al. | |
| 5,655,961 | A | 8/1997 | Acres et al. | |
| 5,674,128 | A | 10/1997 | Holch et al. | |
| 5,695,402 | A | 12/1997 | Stupak | |
| 5,702,303 | A | 12/1997 | Takemoto et al. | |
| 5,768,382 | A | 6/1998 | Schneier et al. | |
| 5,770,533 | A * | 6/1998 | Franchi | 463/42 |
| 5,810,665 | A | 9/1998 | Takemoto et al. | |
| 5,820,459 | A | 10/1998 | Acres et al. | |
| 5,836,817 | A * | 11/1998 | Acres et al. | 463/26 |
| 5,836,819 | A | 11/1998 | Ugawa | |
| 5,884,274 | A | 3/1999 | Walker et al. | |
| 5,890,963 | A | 4/1999 | Yen | |
| 5,910,048 | A | 6/1999 | Feinberg | |
| 6,001,016 | A | 12/1999 | Walker et al. | |
| 6,003,013 | A | 12/1999 | Boushy et al. | |
| 6,018,718 | A | 1/2000 | Walker et al. | |
| 6,089,980 | A | 7/2000 | Gauselmann | |
| 6,113,493 | A | 9/2000 | Walker et al. | |
| 6,135,884 | A | 10/2000 | Hedrick et al. | |
| 6,196,547 | B1 | 3/2001 | Pascal et al. | |
| 6,224,482 | B1 | 5/2001 | Bennett | |
| 6,234,896 | B1 * | 5/2001 | Walker et al. | 463/16 |
| 6,241,608 | B1 | 6/2001 | Torango | |
| 6,244,957 | B1 | 6/2001 | Walker et al. | |
| 6,254,483 | B1 | 7/2001 | Acres | |
| 6,257,981 | B1 | 7/2001 | Acres et al. | |
| 6,270,409 | B1 | 8/2001 | Shuster | |
| 6,273,820 | B1 | 8/2001 | Haste | |
| 6,312,333 | B1 | 11/2001 | Acres | |
| 6,319,125 | B1 | 11/2001 | Acres | |
| 6,409,602 | B1 | 6/2002 | Wiltshire et al. | |
| 6,439,995 | B1 | 8/2002 | Hughs-Baird et al. | |
| 6,626,758 | B1 | 9/2003 | Parham et al. | |
| 6,638,165 | B2 | 10/2003 | Uchiyama et al. | |
| 6,645,078 | B1 | 11/2003 | Mattice | |
| 6,695,697 | B1 | 2/2004 | Okada | |
| 6,857,958 | B2 | 2/2005 | Osawa | |
| 6,869,362 | B2 | 3/2005 | Walker et al. | |
| 6,932,704 | B2 * | 8/2005 | Walker et al. | 463/25 |
| 6,932,707 | B2 * | 8/2005 | Duhamel | 463/42 |
| 6,984,173 | B1 | 1/2006 | Piechowiak et al. | |
| 7,465,232 | B2 | 12/2008 | Okada | |
| 2002/0198039 | A1 | 12/2002 | Marks et al. | |
| 2003/0013516 | A1 | 1/2003 | Walker et al. | |
| 2003/0054873 | A1 | 3/2003 | Peterson | |
| 2003/0064809 | A1 | 4/2003 | Okada | |
| 2003/0064810 | A1 | 4/2003 | Okada | |
| 2003/0069067 | A1 | 4/2003 | Okada | |
| 2003/0069073 | A1 | 4/2003 | Okada | |
| 2003/0073486 | A1 | 4/2003 | Okada | |
| 2003/0073487 | A1 | 4/2003 | Okada | |
| 2003/0078095 | A1 | 4/2003 | Okada | |
| 2003/0119585 | A1 | 6/2003 | Walker et al. | |
| 2003/0220138 | A1 | 11/2003 | Walker et al. | |
| 2004/0048646 | A1 | 3/2004 | Visocnik | |
| 2005/0059480 | A1 | 3/2005 | Soukup et al. | |
| 2006/0009276 | A1 | 1/2006 | Okada | |
| 2007/0060250 | A1 | 3/2007 | Okada | |
| 2007/0060277 | A1 | 3/2007 | Okada | |
| 2007/0060278 | A1 | 3/2007 | Okada | |
| 2007/0060279 | A1 | 3/2007 | Okada | |
| 2007/0060280 | A1 | 3/2007 | Okada | |
| 2007/0060281 | A1 | 3/2007 | Okada | |
| 2007/0060282 | A1 | 3/2007 | Okada | |
| 2007/0060283 | A1 | 3/2007 | Okada | |
| 2007/0060324 | A1 | 3/2007 | Okada | |
| 2007/0105609 | A1 | 5/2007 | Okada | |
| 2007/0105621 | A1 | 5/2007 | Okada | |
| 2007/0105622 | A1 | 5/2007 | Okada | |
| 2007/0149269 | A1 | 6/2007 | Benbrahim | |
| 2008/0058050 | A1 | 3/2008 | Okada | |
| 2008/0058066 | A1 | 3/2008 | Okada | |
| 2008/0064473 | A1 | 3/2008 | Okada | |
| 2008/0064474 | A1 | 3/2008 | Okada | |
| 2008/0064475 | A1 | 3/2008 | Okada | |
| 2008/0064476 | A1 | 3/2008 | Okada | |
| 2008/0096632 | A1 | 4/2008 | Okada | |
| 2008/0102922 | A1 | 5/2008 | Okada | |
| 2008/0102930 | A1 | 5/2008 | Okada | |
| 2008/0119259 | A1 | 5/2008 | Okada | |
| 2008/0119262 | A1 | 5/2008 | Okada | |
| 2008/0125216 | A1 | 5/2008 | Okada | |
| 2008/0139287 | A1 | 6/2008 | Okada | |
| 2008/0139291 | A1 | 6/2008 | Okada | |
| 2008/0146310 | A1 | 6/2008 | Okada | |
| 2008/0153571 | A1 | 6/2008 | Okada | |
| 2008/0161090 | A1 | 7/2008 | Okada | |
| 2008/0214275 | A1 | 9/2008 | Okada | |
| 2008/0293482 | A1 * | 11/2008 | Okada | 463/25 |

FOREIGN PATENT DOCUMENTS

| | | | |
|---|---|---|---|
| DE | 37 12 841 | A1 | 11/1988 |
| DE | 4137010 | | 8/1992 |
| DE | 100 49 444 | A1 | 11/2001 |
| EP | 0631798 | | 1/1995 |
| EP | 0 840 264 | A1 | 5/1998 |
| EP | 1 192 975 | A1 | 4/2002 |
| EP | 1 302 914 | A2 | 4/2003 |
| EP | 1351180 | | 10/2003 |
| EP | 1477947 | | 11/2004 |
| EP | 1 544 811 | A2 | 6/2005 |
| GB | 2326830 | | 1/1999 |
| JP | S61-118377 | U | 7/1986 |
| JP | H04-244178 | A | 9/1992 |
| JP | 06-079051 | | 3/1994 |
| JP | H07-171262 | A | 7/1995 |
| JP | H07-299234 | A | 11/1995 |
| JP | 8-24401 | | 1/1996 |
| JP | H08-029169 | B | 3/1996 |
| JP | H08-336657 | A | 12/1996 |
| JP | 9-28905 | | 2/1997 |
| JP | 09-103576 | | 4/1997 |
| JP | H09-094340 | A | 4/1997 |
| JP | 09-264777 | | 10/1997 |
| JP | 10-33820 | | 2/1998 |
| JP | 10-94666 | | 4/1998 |
| JP | 10-118247 | | 5/1998 |
| JP | H10-234945 | A | 9/1998 |
| JP | 11-19276 | | 1/1999 |
| JP | 11-146938 | | 6/1999 |
| JP | 11-253640 | | 9/1999 |
| JP | 2000-342772 | A | 12/2000 |
| JP | 2001-70510 | | 3/2001 |
| JP | 2001-204885 | A | 7/2001 |
| JP | 2001-259205 | | 9/2001 |
| JP | 2001-269441 | | 10/2001 |
| JP | 2003-47775 | | 2/2003 |
| JP | 2003-47779 | | 2/2003 |
| JP | 2003-53041 | | 2/2003 |
| JP | 2003-53042 | | 2/2003 |
| JP | 2003-71096 | | 3/2003 |
| JP | 2003-71097 | | 3/2003 |
| JP | 2003-71098 | | 3/2003 |
| JP | 2003-111888 | | 4/2003 |
| JP | 2003-111889 | | 4/2003 |
| JP | 2003-111890 | | 4/2003 |
| JP | 2003-111891 | | 4/2003 |
| JP | 2003-111897 | | 4/2003 |
| JP | 2003-117053 | | 4/2003 |
| JP | 2003-117070 | | 4/2003 |
| JP | 2003-117071 | | 4/2003 |
| JP | 2003-117072 | | 4/2003 |
| JP | 2003-117073 | | 4/2003 |
| JP | 2003-177073 | | 4/2003 |
| JP | 2003-126343 | | 5/2003 |
| JP | 2003-205072 | | 7/2003 |
| WO | WO 03/083795 | A1 | 10/2003 |
| WO | 2004/095383 | | 11/2004 |

OTHER PUBLICATIONS

U.S. Appl. No. 11/734,815, filed Apr. 13, 2007, Okada.

U.S. Appl. No. 11/735,016, filed Apr. 13, 2007, Okada.

U.S. Appl. No. 12/183,814, filed Jul. 31, 2008, Okada.
U.S. Appl. No. 12/183,721, filed Jul. 31, 2008, Okada.
U.S. Appl. No. 12/183,654, filed Jul. 31, 2008, Okada.
U.S. Appl. No. 12/183,588, filed Jul. 31, 2008, Okada.
U.S. Appl. No. 12/183,720, filed Jul. 31, 2008, Okada.
Notice of the Office Action issued to U.S. Appl. No. 11/735,104, mailed Apr. 16, 2010, 10 pages.
"Pachi-Slot Hisshogaido Oct. 1996", Byakuya-Shobo Co., Ltd, Oct. 1, 7th Volume, No. 14, 1996, pp. 88 to 89.
"Trick Monster 2, Pachi-Slot Hisshogaido Max 2001, Oct. 2001" Byakuya-Shobo, Oct. 1, 2001, 4 pages (With English Abstract).
Office Action mailed Oct. 12, 2010, in co-pending U.S. Appl. No. 11/734,993, filed Apr. 13, 2007.
Office Action mailed Oct. 25, 2010, in co-pending U.S. Appl. No. 11/735,104, filed Apr. 13, 2007.
Office Action mailed Oct. 27, 2010, in co-pending U.S. Appl. No. 11/735,062, filed Apr. 13, 2007.
Office Action mailed Nov. 2, 2010, in co-pending U.S. Appl. No. 12/183,654, filed Jul. 31, 2008.
Office Action mailed Dec. 10, 2010, in co-pending U.S. Appl. No. 12/183,720, filed Jul. 31, 2008.
Office Action mailed Dec. 10, 2010, in co-pending U.S. Appl. No. 12/183,814, filed Jul. 31, 2008.
Japanese Office Action for Patent Application No. 2007-204699, Issued Aug. 10, 2010.
Office Action issued Dec. 14, 2010 in Japan Application No. 2007-204698.
"Pachi-Slot Daizukan 2001" Byakuya-Shobo Co., Ltd. May 12, 2001, pp. 22, 24, 36.

* cited by examiner

GAME SERVER, GAME MACHINE, AND GAME CONTROL METHOD

CROSS-REFERENCE TO RELATED APPLICATIONS

This application is based upon and claims the benefit of priority from the prior Japanese Patent Application No. 2001-306774, filed Oct. 2, 2001, the entire contents of which are incorporated herein by reference.

This application is related to co-pending U.S. patent application entitled "Game Server, Game Machine, and Game Control Method" filed on even date herewith. The co-pending application is expressly incorporated herein by reference.

FIELD OF THE INVENTION

The present invention relates to a technique of controlling payout return in game machines for pachislo game (Japanese slot game), pachinko (pinball game), etc.

BACKGROUND OF THE INVENTION

A game machine for pachislo game, pachinko, etc. is generally constructed so that the game is started when the player throws a game medium such as a medal in the game machine. The game machine of this type is set so as to pay out the game medium corresponding to the winning state (style) generated while the game is in progress.

This game machine generates a winning state, e.g., so-called "big prize (big bonus)," at a preset probability. Therefore, the player enjoys the game in expectation of big prize on the game machine with which the player is currently playing.

The game machine that produces a prize depending on the probability as described not always produces the prize at a fixed probability. That is, it is constructed so as to converge on a preset probability when a significant number of games are digested. As the result, the player performing a small number of games is likely to quickly generate a prize, and the player performing a large number of games is less likely to generate a prize. With the game machine of this type, gambling characteristics can be enhanced to make the game more amusing. On the other hand, the player less likely to generate a prize might lose enthusiasm for the game. This leads to a tendency to miss the player (customer).

In order to solve the above disadvantage, a variety of game machines have been proposed.

In a game machine disclosed in Japanese Patent Unexamined Publication No. 8-24401, there are two probability tables for controlling the probability of generating a big prize. When the player performing a large number of games is less likely to generate a prize, one of the two probability tables that has a higher probability is selected for change, thereby increasing the probability of generating the prize.

Japanese Patent Unexamined Publication Nos. 6-79051 and 11-253640 have proposed game machines employing means that is called "payout return." The term "payout return" means to repay a certain game medium per game machine on meet of a predetermined condition, in accordance with the amount of game media (e.g., medals) the player thrown in the machine. A game machine of payout return type in the former is constructed so as to improve game characteristics by controlling the payout return rate as a basis for repay of game media. A game machine of payout return type in the latter is constructed so as to adjust the probability of generating a prize in consideration of the profit rate in the parlor and the payout return rate to each game machine.

Specifically, the game machines disclosed in the above Publication Nos. 6-79051 and 11-253640 adjust the probability of generating a prize and the payout return rate, thereby aim at eliminating the drawback that the player having a large number of games is less likely to generate a prize, as is often with the conventional game machines.

Although the game machine of the above Publication No. 8-24401 has succeeded in eliminating unevenness in the probability of causing a prize, the following problem remains.

In this game machine, control of "unevenness" is performed per game machine. It is therefore impossible to eliminate unbalance between players. As the result, the player cannot enjoy the game without anxiety. For instance, one player plays the game with one game machine for a while, without generating any prize, and then moves to the other game machine. Immediately thereafter, the other player who sits on one game machine is likely to generate a prize. Under the circumstances, it is unavoidable that the player is in constant suspense when continuing the game with one game machine and moving to the other game machine. Hence, the problem that the player is away from the game due to such suspense, being called "missing customers," remains unsolved.

As in the game machine of the above Publication No. 8-24401, the game machines of payout return type in the above Publication Nos. 6-79051 and 11-253640 are constructed so as to control payout return per game machine. Consequently, the both machines also suffer from the same drawback, and the problem of missing customers remains unsolved.

SUMMARY OF THE INVENTION

According to the present invention, it is an object to overcome the above-described technical problem by constructing such that the player can play a game without anxiety while retaining amusement of the game, thereby eliminating the problem of missing customers.

In accordance with the present invention, the above object may be achieved by producing higher game characteristics in the following manners comprising: (i) managing per player the credit cumulative consumption in a game machine placed in a parlor and, when the credit cumulative consumption of a certain player reaches a predetermined upper limit, performing a payout return to the player; and (ii) performing switching between a display status displaying information about the upper limit and a non-display status displaying no information, in accordance with the play status.

(1) There are the following two premises: i) bringing plural game machines into status enabling to start a game based on throwing of coins or a given credit number, and collectively controlling payout to the game machines according to the result of the game; and ii) determining a credit cumulative consumption based on information about the credit consumption in a game machine on which a player is playing the game, and performing payout return without fail based on a predetermined payout return rate when the credit cumulative consumption reaches a predetermined upper limit, or performing payout return based on the result of lottery for judging whether the payout return should be done. Under these premises, there are executed the following operations: i) receiving a play information about the play status in each game machine; and ii) according to the contents of the received play information, performing switching between a display status displaying information about the predetermined upper limit and a non-display status that does not display this information on a display part of the game machine.

With this construction, the information about the predetermined upper limit will be displayed or not displayed on the display part, depending on the play status of each game machine. Therefore, the player can enjoy the game while getting a kind of thrill. In other words, the player continues the game without information as to when and how much payout return the player can receive by consuming credit to what extent. As the result, the player will be lucky by unexpected payout return, or feel uneasy and has expectation when the player is impatient for payout return.

(2) Preferably, the above-mentioned payout return is performed without fail to the game machine that reaches the predetermined upper limit and executed based on the result of a timing decision lottery for determining the timing of the payout return.

With this construction, payout return is performed without fail to the game machine that reaches the predetermined upper limit. With guarantee for payout return, the player can enjoy the game without anxiety. Since the timing of payout return is determined by lottery, payout return is not always performed as soon as the game machine reaches the upper limit, which might improve game characteristics. If the game machine is constructed such that the player cannot recognize that the machine reaches the upper limit, there is the possibility that the player is not anxious about the upper limit setting and thus fails to improve game characteristics. It is therefore preferable to construct so as to inform that the machine reaches the upper limit. In this instance, higher game characteristics can be produced by performing switching between a status displaying a gap to the upper limit and a status not displaying until the machine reaches the upper limit, in accordance with the play status of the player.

(3) Preferably, when it is detected that there is change from one player to the other player who performs a game on a certain game machine in plural game machines under collective control and payout return is executed based on the result of detection, the payout return is effected by regarding, as one player, the player continuing the game until he/she reaches a predetermined upper limit with the certain game machine, on condition that the change from one player to the other player is not detected.

With this construction, it is decided per player as to whether the predetermined upper limit is attained or not, which has been heretofore performed per game machine. This ensures a certain payout return for the player. For example, if the instance that one player continues the game with the same game machine is compared with the instance that the player changes game machines many times, the former is more subject to payout return when the credit cumulative consumption of the player reaches the predetermined upper limit. Hence, the player is more likely to continue the game with the same game machine. As the result, it is possible to solve the problem of missing customers that has occurred in the conventional game machines performing payout return per game machine.

(4) Preferably, when it is detected that there is change from one player to the other player who performs the game on the mentioned certain game machine, a signal for resetting the credit cumulative consumption of one player on the certain game machine is sent to the certain game machine.

With this construction, when it is detected that a game player who starts a game on a certain game machine stops the game before reaching a predetermined upper limit and then the game player changes from one player to the other player, the credit cumulative consumption of one player (the previous player) is reset. Thereby, as in the invention of the aspect (3), it is capable of ensuring payout return for the player laying out game medium, not the game machine. As the result, the player can continue the game with the currently playing game machine without anxiety. It is also capable of inducing the player to continue the game until payout return is executed. In addition, the following imbalance between players can be minimized. That is, in the conventional game machines performing payout return per game machine, for example, when one player changes one game machine that he/she has played till then to the other game machine, "the other player, the following next player of one game machine, reaches the predetermined upper limit as soon as the game is started and obtains payout return." Thereby, there is the chance of recover customers who have been away from the conventional game machines performing payout return per game machine, for the reason of imbalance between players.

(5) Preferably, the information about the predetermined upper limit is information of gap between the predetermined upper limit and the credit cumulative consumption in a certain game machine in plural game machines under collective control.

With this construction, in accordance with the play status of each game machine, information about how soon the player can reach the upper limit will be displayed or not displayed on the display part of the game machine. Thereby, there is the chance of providing high game characteristics to the player. In other words, the player is unaware that he/she must consume credit to what extent in order to obtain payout return. As the result, the player will be lucky by unexpected payout return, or feel uneasy and has expectation when the player is impatient for payout return.

(6) Preferably, the information about the play status is information as to whether a certain game machine in plural game machines under collective control is in play status or not.

With this construction, if a certain game machine is in play status, information of a predetermined upper limit is displayed on its display part. If the game machine is not in play status, the information is not displayed on the display part. Thereby, there is the chance that the player can get a high thrill from the time of selecting one from plural game machines. In other words, the player selects the game machine without information as to "when and how much payout return the player can receive by consuming credit to what extent." As the result, the player will be lucky if he/she finds that it is close to the upper limit, or feel unlucky if he/she finds that the selected game machine is far from the upper limit.

Definition of Terms (1) The term of "game machine" may include a pachinko game machine, a slot game machine, etc. The game machine may contain a mechanism capable of performing games in order to increase the player's profit by using some medium.

(2) The term of "given credit number" may include a winning ball, a medal, and cash (e.g., hard money, and paper money) which the player throws in the game machine for playing the game. The given credit number may be made into a numerical data such as electronic money and a prepaid card, etc.

(3) The term of "consumption" may mean that the player intimates his/her intension to play a game and actually plays the game by using the given credit, without reference to tangible or intangible.

(4) The term of "predetermined upper limit" may include in principle one which is used as a basis for a payout return to be set per game machine. For example, the upper limit is set with the use of the basis; i) the number of medals used in a slot game machine; and ii) how many the player rotates a rotating drum of the slot game machine (i.e., the number of plays). Although the term of "upper limit" is generally of large or small value, the term "upper limit" as applied in this specification is preferably expressed in numerical value of enough magnitude to reach there within a period of time that game machines are provided by the provider of the game machines (e.g., the business hours of parlors etc.), in view of the essence of this invention.

(5) The term of "predetermined payout return" may include in principle one which is changed depending on the setting contents of the mentioned predetermined upper limit, and which is generally obtained by multiplying the upper limit value by a payout return rate (usually below 100%). Specifically, when the basis for the predetermined upper limit is the number of medals used in a slot game machine etc., payout return is executed by offering medals to the player. When the basis for the predetermined upper limit is the number of plays, payout return is executed by offering a free play to the player.

(6) The term of "gap to the upper limit" may include one which expresses how the credit cumulative consumption of a game machine is close to the predetermined upper limit. If the predetermined upper limit is expressed in the number of credits, the gap to the upper limit may be expressed by the result obtained by deducting the number of credits that the player has consumed from the number of credits that is preset as the upper limit.

The present invention, advantage in operating the same and aims which is attained by implementing the present invention will be better appreciated from the following detailed description of illustrative embodiment thereof, and the accompanying drawings.

DETAILS DESCRIPTION OF THE PREFERRED EMBODIMENT

One preferred embodiment of the present invention will be described below in detail, based on the accompanying drawings.

1. Overall Configuration of System

Figure 1:
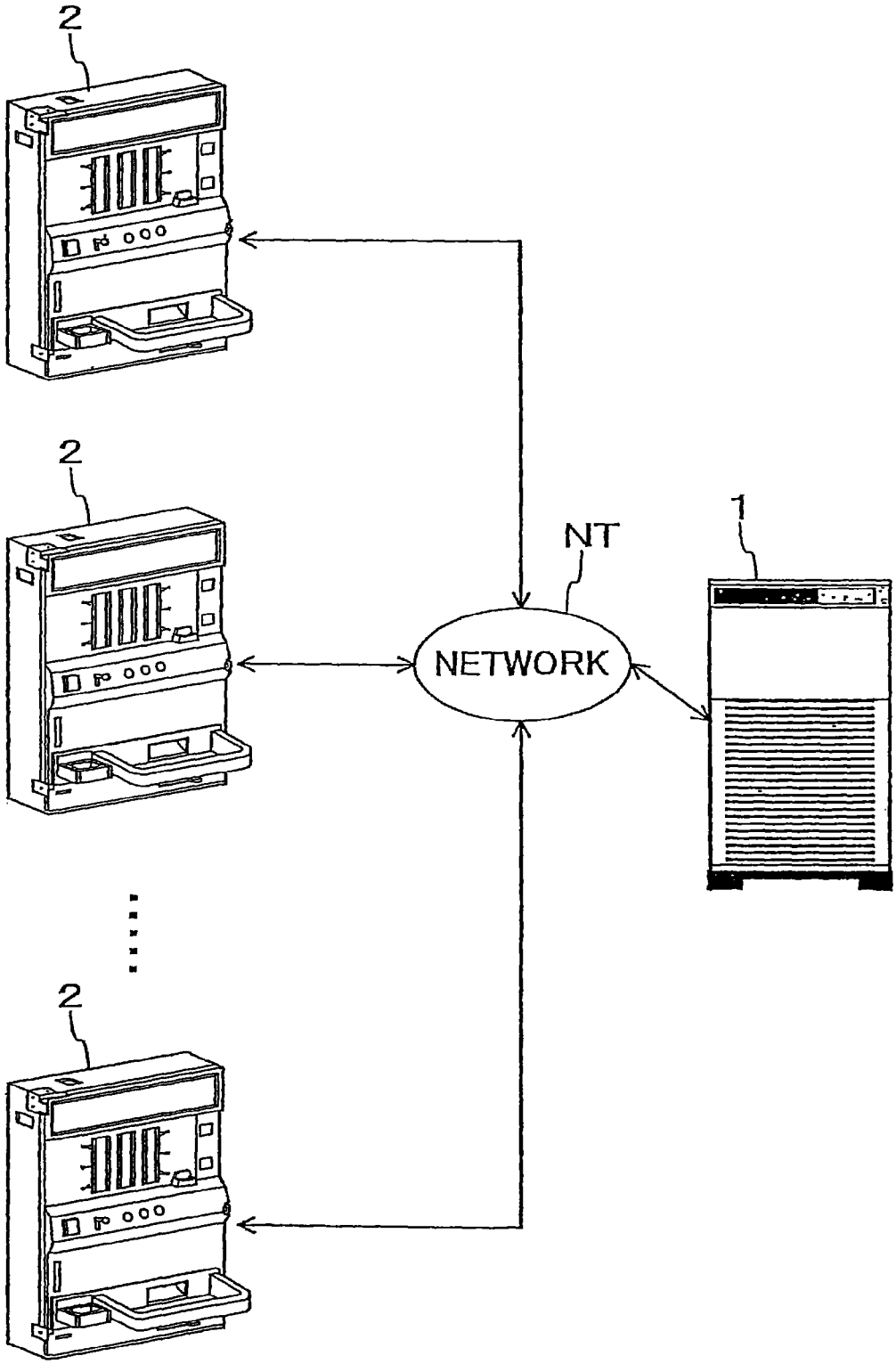
FIG. 1 is a diagram showing, in simplified form, the configuration of a credit payout return system according to one preferred embodiment of the present invention.

FIG. 1 is a diagram showing, in simplified form, the configuration of a credit payout return system according to one preferred embodiment of the invention. Referring to FIG. 1, this credit payout return system comprises: i) a game server 1; and ii) plural game machines 2 placed in a single parlor.

The game machines 2 are connected via a network NT to the game server 1 and can send to and receive from the game server 1 a variety of information via the network NT. Individual identification numbers are assigned to the game machines 2.

The game server 1 collectively controls the plural game machines 2 and discriminates the source of data sent from the game machines 2, based on the identification numbers being individual to the game machines 2. When the game server 1 sends data to the game machine 2, the game server 1 designates the destination of the data by using the corresponding identification number.

Data sent from and received by the game machine 2 contain: i) the identification number being individual to this game machine; and ii) identification information to identify the player currently playing with this game machine. Based on the identification information, the game server 1 discriminates as to whether: i) a game is performed on the game machine 2; and ii) there is a player change on this game machine 2.

Hereinafter, the game server is merely referred to as a "server."

2. Configuration of Game Machines

Figure 2:
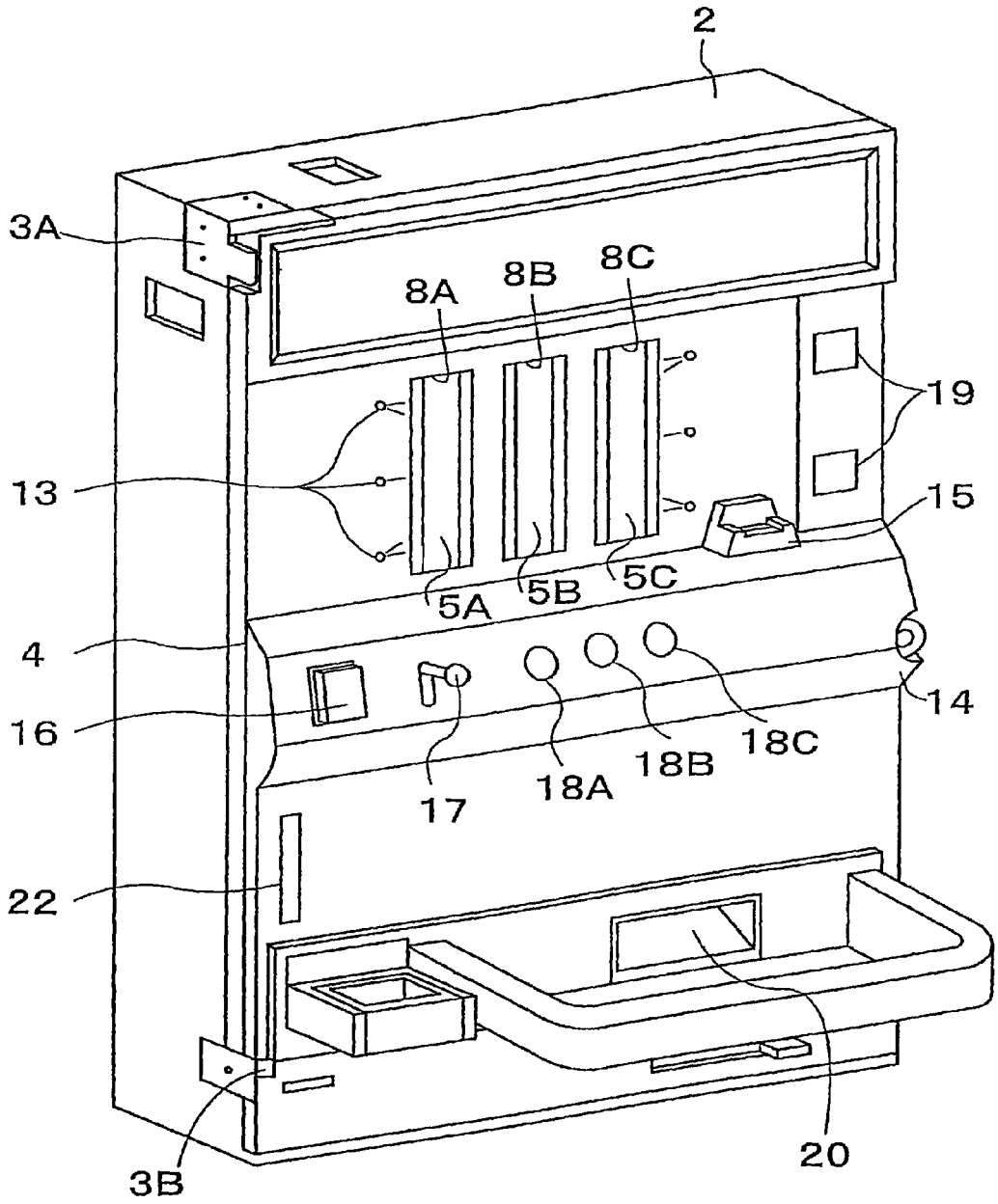
FIG. 2 is a perspective view showing the appearance of a game machine.
Figure 3:
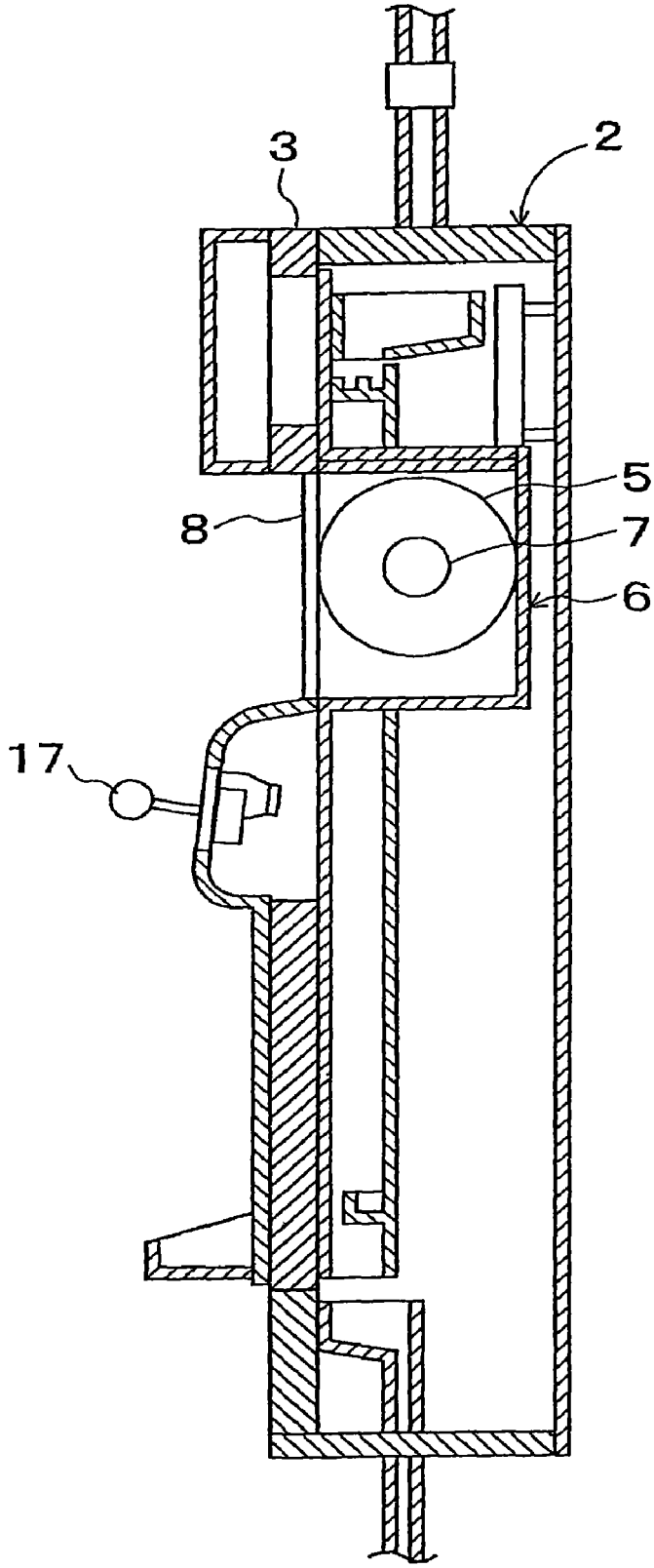
FIG. 3 is a vertical sectional view of the game machine.

FIG. 2 is a perspective view showing the appearance of a game machine FIG. 3 is a vertical sectional view of the game machine. Referring to FIGS. 2 and 3, a game machine 2 is a slot game machine (slot machine) and has a frame body 3.

The frame body 3 is in the shape of hollow box. A front panel 4 is attached so that it is able to open and shut to the frame body 3 via hinges 3A and 3B.

Attached to the rear surface of the front panel 4 is a casing 6, with which three rotating drums 5 (5A to 5C) arranged across the width thereof are covered from their back face.

The drums 5A to 5C are of tubular shape and are supported rotatively about rotary axes 7. Symbol marks (e.g., figure "7", bell, plum, cherry etc.) are respectively drawn on the peripheral surfaces of the drums 5A to 5C such that the symbol marks are aligned in a row around their periphery. Of the symbol marks drawn on the peripheral surfaces of the drums 5A to 5C, one symbol mark per drum is visible from the front side of the game machine 2 via windows 8A to 8C disposed on the front panel 4.

The rotary axes 7 of the drums 5A to 5C are attached rotatively via bearings (not shown) to a predetermined bracket (not shown) of the frame of the game machine 2. One ends of the rotary axes 7 are joined to output axes of stepping motors 11A to 11C (see FIG. 4). Thereby, the drums 5A to 5C are rotatably driven by the stepping motors 11A to 11C, respectively, and controlled such that they are stopped at a predetermined rotational angle position by a control device 12 (see FIG. 4).

Projection parts (not shown) indicating a standard position are disposed on the peripheral end parts of the drums 5A to 5C. The control device 12 detects the rotational standard positions of the drums 5A to 5C when these projection parts cross the optical axes of optical sensors (not shown), which are disposed so as to correspond to the drums 5A to 5C. The rotational speed of the stepping motors 11A to 11C is set so as to make constant a speed at which symbol marks are displayed while changing.

Bet line indicator lamps 13 are disposed adjacent to the windows 8A to 8C. The lamps 13 are provided for indicating which line of plural symbol mark stop lines displayed on windows 8A to 8C has been selected as a bet object.

A control part 14 is located at approximately the mid section of the front panel 4, and a bet button 16 is disposed in the control part 14. The bet button 16 is provided for setting a bet of medals entered via a throw-in slot 15. When the player pushes the bet button 16 by the amount of medals on which the player desires to bet, the corresponding bet line indicator lamp 13 is light up. The upper limit of bet medals is three in the game machine 2.

The bet lines are different depending on the operation number of the bet button 16. By one operation, a single line extending horizontally in the middle stage of the windows 8A to 8C is the object of bet line. By two operations, the object of bet line amounts to three lines obtained by adding two lines extending horizontally in the upper and lower stage of the windows 8A to 8C, to the above-mentioned line. By three operations, the object of bet line amounts to five lines obtained by adding two lines on the diagonal of the windows 8A to 8C, to the above-mentioned three lines. Four or more operations are invalid.

When a bet medal number is set according to the above-mentioned procedure, the control device 12 takes medals corresponding to the bet medal number set by the player. By taking the medals, the condition of starting slot game is established. In this state, when the player operates a start lever 17, the control device 12 rotates the drums 5A to 5C.

The control part 14 has three stop buttons 18A to 18C disposed at locations that correspond to the drums 5A to 5C, respectively. Depressing the stop buttons 18A to 18C, the corresponding drum is stopped.

The front panel 4 has digital score indicators 19 for indicating: i) the number of medals the player threw in for the game; and ii) the number of medals to be discharged. When one of predetermined specific combinations of symbol marks (winning state) in the drums 5A to 5C is aligned on the stop line on which the player bets, a medal marks (winning state) discharge device (not shown) is driven to discharge a predetermined number of medals to a medal payout tray 20.

Further, the front panel 4 has a card inlet 22, through which the player inserts a card storing an identification number data to identify the player when he/she plays a game with the game machine 2. A card reader 23 (see FIG. 4) reads the data of the inserted card.

3. Configuration of Control Device of Game Machine

Figure 4:
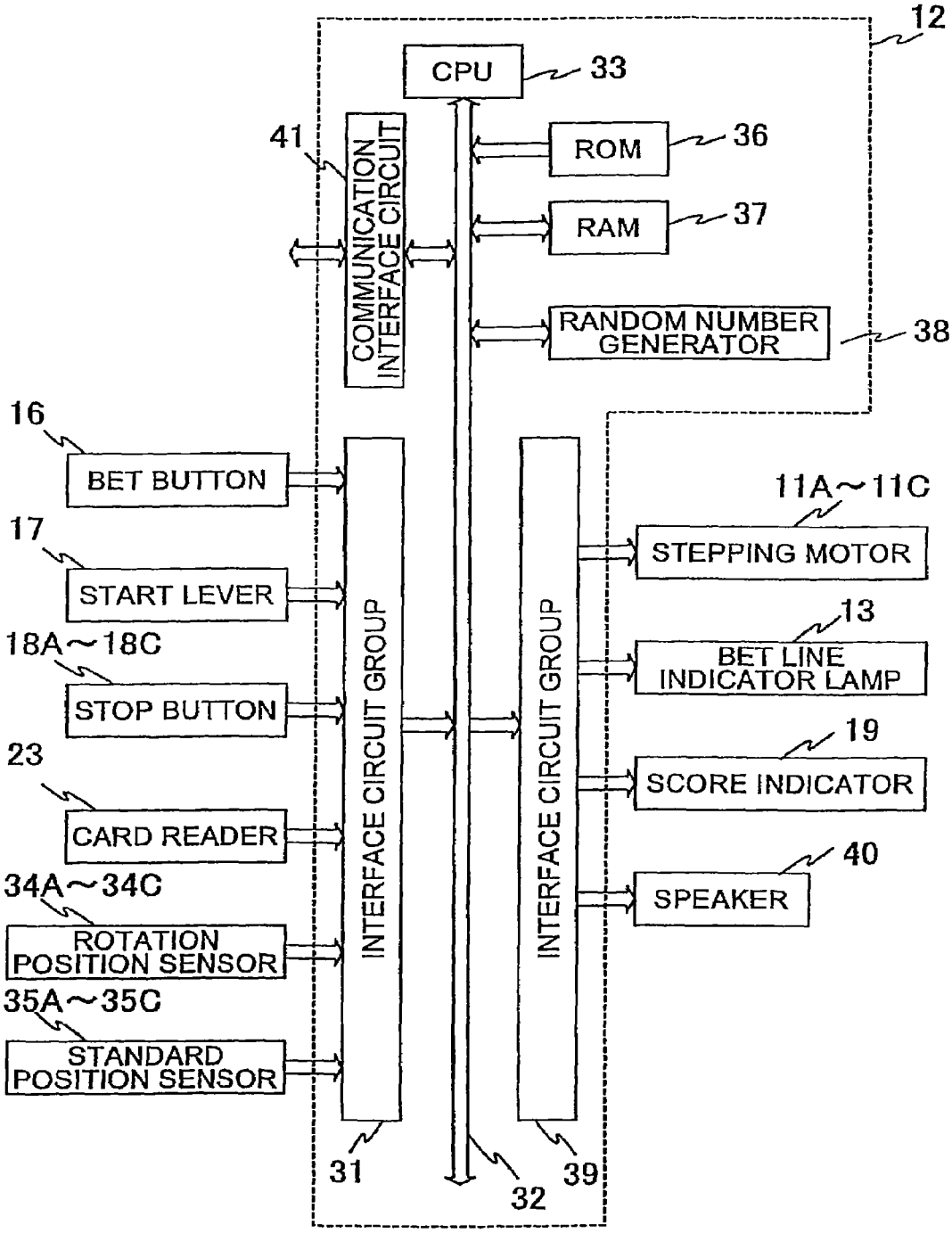
FIG. 4 is a block diagram showing the electrical configuration of the game machine.

FIG. 4 is a block diagram showing the electrical configuration of the game machine. Referring to FIG. 4, the control device 12 of the game machine 2 comprises: i) first interface circuit group 31; ii) input/output bus 32; iii) CPU 33; iv) ROM 36; v) RAM 37; vi) random number generator 38; vii) second interface circuit group 39; and viii) communication interface circuit 41.

The bet button 16 is connected to the first interface circuit group 31 being connected to the input/output bus 32. When the player depresses the bet button 16, an operation signal is issued from the bet button 16 to the interface circuit group 31. The interface circuit group 31 converts the operation signal to a predetermined voltage signal and provides it to the input/output bus 32. Accordingly, before starting a play, a predetermined number of medals corresponding to a value indicated by the operation signal are thrown into the game machine 2 as the object of bet.

The input/output bus 32 performs input/output of data signals or address signals to the CPU 33.

The start lever 17 and stop buttons 18A to 18C are connected to the first interface circuit group 31, on which i) a start-up signal issued from the start lever 17; and ii) a stop signal issued from the stop buttons 18A to 18C, are converted to predetermined voltage signals and then provided to the input/output bus 32.

When the start lever 17 is operated to start a game, the start-up signal is provided to the CPU 33. Receive of the start-up signal, the CPU 33 issues a control signal to the stepping motors 11A to 11C in order to rotate the drums 5A to 5C.

When the stop buttons 18A to 18C are depressed to stop the drums 5A to 5C, the respective stop signals from the stop buttons 18A to 18C are provided to the CPU 33. If desired to stop the first drum 5A, the player operates the stop button 18A. If desired to stop the second drum 5B, the player operates the stop button 18B. If desired to stop the third drum 5C, the player operates the stop button 18C. Receive of the stop signal, the CPU 33 issues the stop signal to the stepping motors 11A to 11C, in order to stop the drum corresponding to the operated stop button.

Rotational position sensors 34A to 34C are connected to the first interface circuit group 31. The sensors 34A to 34C are disposed in the vicinity of the stepping motors 11A to 11C, respectively. The sensors 34A to 34C issue angle position signals that respectively indicate the rotational angle positions of the stepping motors 11A to 11C, to the interface circuit group 31. For example, rotary encoders can be employed as the rotational position sensors 34A to 34C.

Standard position sensors 35A to 35C are connected to the first interface circuit group 31. The sensors 35A to 35C are disposed in the vicinity of the drums 5A to 5C, respectively. The sensors 35A to 35C are optical sensors as described above, and issue standard position signals to the interface circuit group 31 when detecting the standard positions of the drums 5A to 5C.

The card reader 23, which is disposed within the game machine 2, is connected to the first interface circuit group 31. The card reader 23 issues a card status signal at a predetermined timing, in accordance with a signal sending demand from the CPU 33. When a card is inserted into the card inlet 22 (see FIG. 2), for example, the signal level of the card status signal is higher than a standard level. Based on the change in signal level, the CPU 33 detects that the card is inserted. On the other hand, when no card is inserted (i.e., the state that the card has been drawn out from the card inlet 22), for example, the level of the card status signal payout returns to the standard level. Based on the change in signal level, the CPU 33 detects that no card is inserted.

The CPU 33 detects: i) an angle position signal issued from the rotational position sensors 34A to 34C; and ii) a standard position signal issued from the standard position sensors 35A to 35C, thereby obtaining data of symbol marks displayed on the windows 8A to 8C.

The ROM 36 and RAM 37 are connected to the input/output bus 32. The ROM 36 stores: i) a program for controlling the game machine and returning medals; and ii) an initial value of variable used in the program. The ROM 36 stores data group indicating correspondence between a combination of symbol marks and random numbers. The RAM 37 stores flags and variable values.

The communication interface circuit 41 is connected to the input/output bus 32. The circuit 41 is used when performing sending/receiving of data between the game machine 2 and server 1.

The random number generator 38 for generating the above random numbers is connected to the input/output bus 32.

When the CPU 33 issues an instruction for generating random numbers issued to the random number generator 38, the random number generator 38 generates random numbers in a predetermined range, and issues signals indicating the random numbers to the input/output bus 32. When a random number is issued from the random number generator 38, in order to determine a combination of symbol marks that corresponds to the random number, the CPU 33 searches the above data group and then substitutes a value corresponding to the combination to variables.

Usually either one of normal game and special game can be played with the game machine 2.

In the normal game, there are i) an enabled prize-winning status that a combination of symbol marks stopped and displayed on an effective line can match a prize-winning pattern; and ii) unabled prize-winning status that a combination of symbol marks cannot match a prize-winning pattern.

In the unabled prize-winning status, examples of symbol mark combinations that change on effective lines are: i) failure pattern; and ii) small prize pattern. The term "small prize" means that a predetermined number of symbol marks such as "cherry" and "bell" are aligned on the effective line, and a few medals are discharged to the payout tray 20. The term "failure pattern" means that the above-mentioned symbol marks are not aligned on any effective line, and no medals are discharged. The unabled prize-winning status can move to the enabled prize-winning status by an internal lottery processing to be described hereafter. In the unabled prize-winning status, any prize-winning pattern cannot be aligned irrespective of a timing at which the stop buttons 18A to 18C are depressed. Hence, it is impossible to move from the normal game status to the special play status.

On the other hand, only in the enabled prize-winning status, a combination of symbol marks stopped and displayed by a timing at which the stop buttons 18A to 18C are depressed will match a prize-winning pattern. In other words, this state allows for "aiming (observation push)." When a combination of symbol marks stopped and displayed on an effective line matches a prize-winning pattern, the player wins a prize and the game style moves to the special game providing a chance of obtaining a large number of medals. When the player fails to obtain any prize-winning pattern by missing a timing of depressing the stop buttons 18A to 18C, the above-mentioned failure pattern or small prize pattern is aligned on the effective line. If once the enable prize-winning status is set, this status continues until a combination of symbol marks stopped and displayed matches a prize-winning pattern. There is no change (move) to the unable prize-winning status.

In the special game, there is extremely high probability that a combination of symbol marks stopped and displayed on an effective line will match a small prize pattern. This leads to a high possibility of obtaining a large number of medals. Finishing the special game, the game style moves to the normal game. When the normal game is performed after the special game, a decision as to whether the game proceeds in the enabled prize-winning status or the unabled prize-winning status is made by an internal lottery processing to be described hereafter.

The second interface circuit group 39 is also connected to the input/output bus 32. To the circuit group 39, there is connected: i) stepping motors 11A to 11C; ii) bet line indicator lamp 13; iii) score indicator 19; and iv) speaker 40. The circuit group 39 applies a drive signal or drive power to each of these devices. For instance, when the player depresses the bet button 16, a drive current is applied to the bet line indicator lamp 13, in order to indicate a bet line that becomes effective in accordance with the number of throw-in medals. When the game (play) is over, a drive signal is applied to the score indicator 19, in order to indicate the score corresponding to the prize-winning status at that time. The speaker 40 issues an effect voice corresponding to the game status when the game is started or over.

4. Configuration of Game Server

Figure 5:
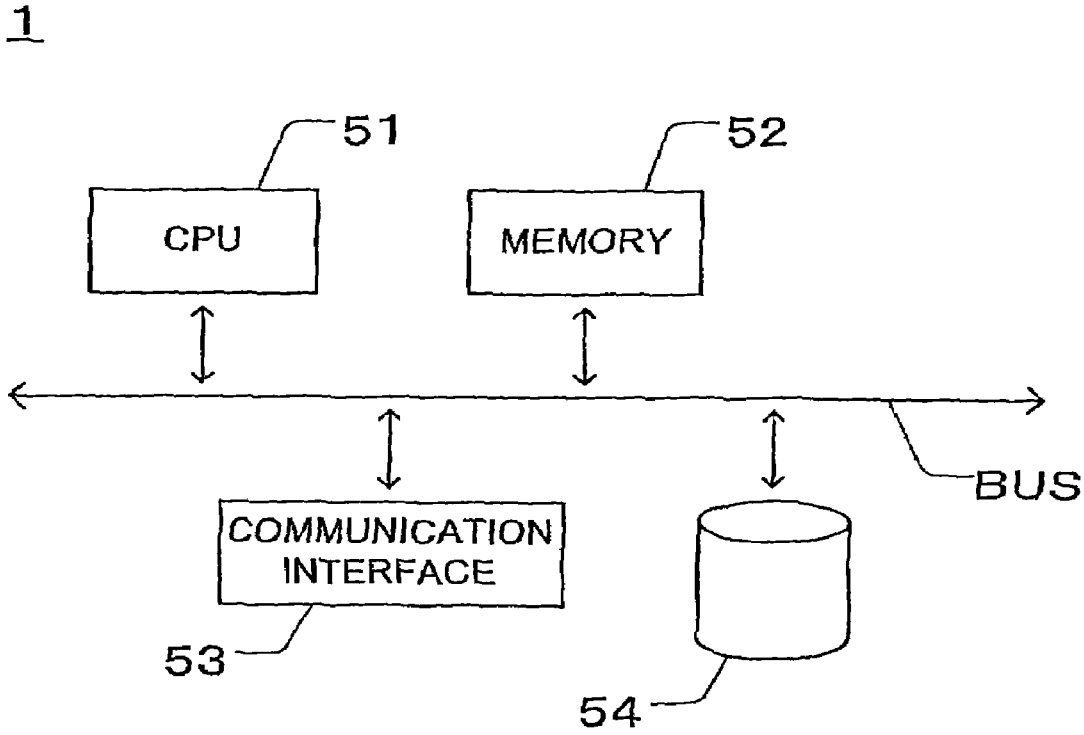
FIG. 5 is a block diagram showing the electrical configuration of a game server.

FIG. 5 is a block diagram showing the electrical configuration of the game server. Referring to FIG. 5, a server 1 has a data bus BUS. To the data bus BUS, there is connected i) CPU 51; ii) memory 52; iii) communication interface 53; and iv) database 54.

The CPU 51 executes various processing according to programs stored in the memory 52. Specifically, the CPU 51 receives data from the game machine 2 via a communication line connected by the communication interface 53, and stores the data in the memory 52. This data is for example the upper limit data and payout return rate data of plural game machines 2 under the control of the server 1, that is, information sent from each game machine 2 under the control of the server 1. The CPU 51 reads a program stored in the database 54 on the memory 52, and progresses the program based on the information sent from each game machine 2 that is stored in the memory 52. The progress of the program is stored in the database 54.

It is assumed in the following, for purposes of description, that the game machine 2 is activated in advance, and flags and variables are initialized to a predetermined value.

5. Flow of Control of Game Machines

Figure 6:
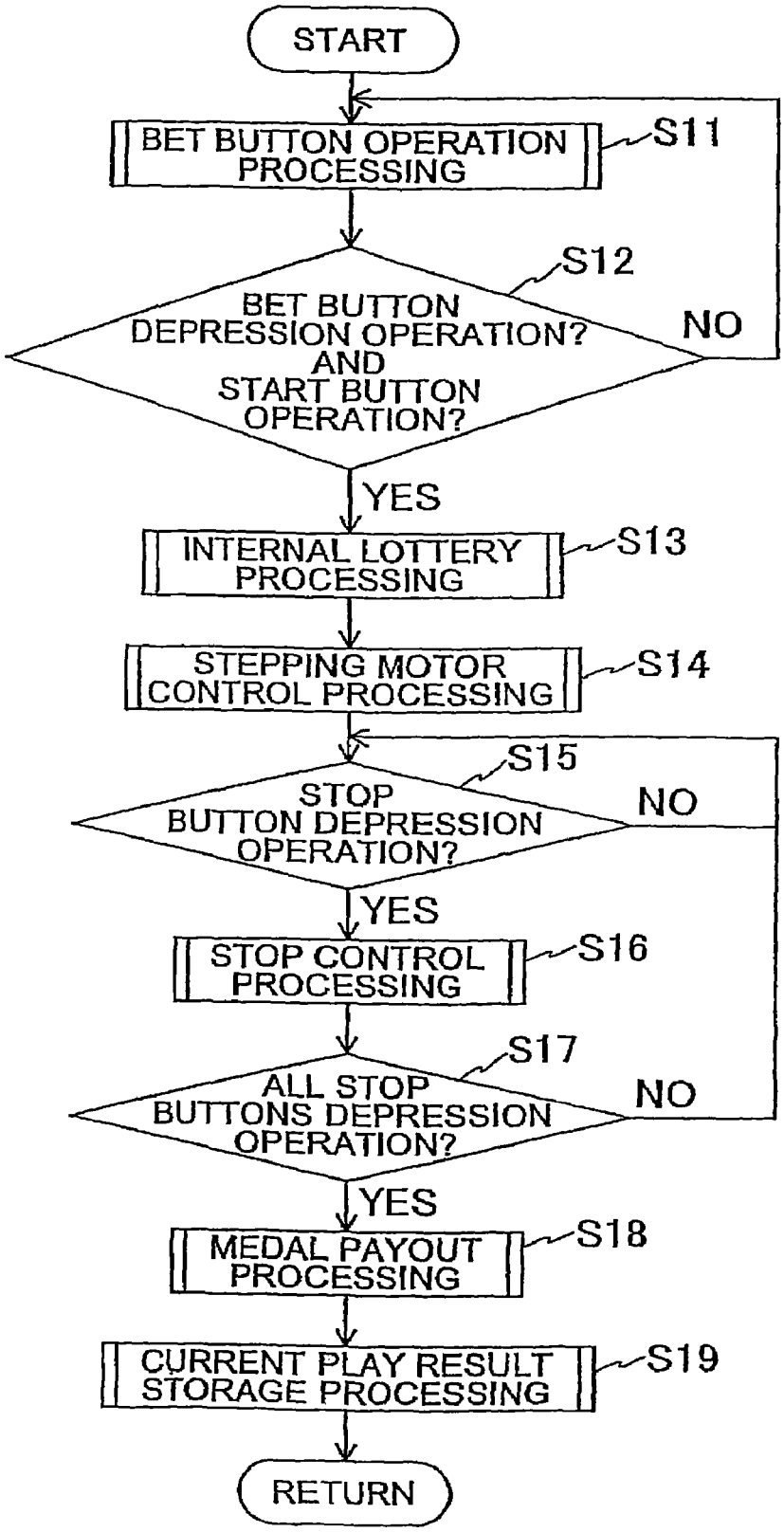
FIG. 6 is a flowchart showing the flow of control of the game machine.

FIG. 6 is a flowchart showing the flow of control of game machines. Referring to FIG. 6, firstly, the CPU 33 of the game machines 2 performs a bet-button operation processing in which it is judged whether the player pushes the bet button 16 (step S11). The bet-button operation processing is executed in accordance with the operation of depressing the bet button 16, and includes the following processing: i) detecting whether an operation signal is issued from the bet button 16 in response to an operation to the bet button 16, thereby storing the number of throw-in medals with the operation; and ii) issuing a drive signal to the bet line indicator lamp 13, in order to indicate the bet line that becomes effective in accordance with the number of throw-in medals.

Upon completion of the bet-button operation processing, the CPU 33 judges whether the pressing operation of the bet button 16 is performed and the operation of the start lever 17 is performed (step S12). When the CPU 33 judges both operations are performed, the CPU 33 moves the processing to step S13. When the CPU 33 judges both are not performed or none of these operations are performed, the CPU 33 returns the processing to step S11, and performs the bet-button operation processing again. As will be described hereafter, a period of time that all the drums 5A to 5C are started in rotation and are brought into a stop is a sequence of game (play).

Moving the processing of step S13, the CPU 33 executes processing for internal lottery. The internal lottery processing includes processing of: i) controlling the random number generator 38 to generate a random number; and ii) searching data group indicating the correspondence between combinations of symbol marks and random numbers, thereby deciding a combination of symbol marks in accordance with the generated random number. The combination of symbol marks stopped and displayed on the previous game is stored in the RAM 37, as will be described hereafter. In the following game, the CPU 33 reads the combination of symbol marks stored in the RAM 37, so that it is used for internal lottery processing.

In the internal lottery processing, a combination of symbol marks that can be stopped and displayed is determined by lottery, and a value indicating the lottery result is substituted to a lottery data of the currently performing game (current game lottery data). For instance, when it is in the unabled prize-winning status and in failure pattern, the current game lottery data is set to "00" When it is in the unabled prize-winning status and there occurs the symbol marks combination matching with a small prize pattern, the current game lottery data is set to "01". When it is in the enabled prize-winning status, the current game lottery data is set to "12". When it is in the special play status and in failure pattern, the current game lottery data is set to "20". When it is in the special play status and there occurs the symbol marks combination matching with a small prize pattern, the current game lottery data is set to "21". Instead of performing any special internal lottery processing, the stopped symbol mark may be used to check whether the player moves to an advantageous status.

Upon completion of the processing of step S13, the CPU 33 reads a subroutine about stepping motor control processing (not shown) and issues, based on the subroutine, control signals to the stepping motors 11A to 11C, in order to drive each motor at a predetermined rotational speed (step S14). The term "rotational speed" means a speed at which the symbol marks are changeably displayed by the rotation of the drums 5A to 5C in the above-mentioned sequence of game (play). That is, any speed in the transient rotation state, such as of immediately after the drums 5A to 5C starts rotation and immediately before they are brought into a stop, are excluded from the concept of the rotational speed.

In this preferred embodiment, there is a lottery data of the game performed in the past that corresponds to the above-mentioned current game lottery data. The past game lottery data is data indicating the lottery result of the game performed before the current game, and the data is stored in the RAM 37. As will be described hereafter, in the normal game to which the game style moves when the special game is over, the past game lottery data is reset at the time of performing the fast game. The past game lottery data is updated by sequentially accumulating the current game result in the previous game result.

Upon completion of the above-mentioned stepping motor control processing, the CPU 33 judges whether the player depressed any one of the stop buttons 18A to 18C in order to stop the drums 5A to 5C, and from which stop button a stop signal is issued (step S15). If judged that no stop signal is issued from the stop buttons 18A to 18C, the CPU 33 executes again the processing of step S15. If judged that a stop signal is issued from any one of the stop buttons 18A to 18C, the CPU 33 performs processing for stopping the stepping motors 11A to 11C (step S16). This stop control processing includes: i) controlling the random number generator 38 to generate a random number; and ii) searching data group indicating the correspondence between combinations of symbol marks and random numbers, thereby deciding a combination of symbol marks in accordance with the generated random number.

The CPU 33 obtains a symbol mark currently appearing on the windows 8A to 8C, based on i) a rotational position signal issued from the rotational position sensors 34A to 34C; and ii) a standard position signal issued from the standard position sensors 35A to 35C. Based on the above-mentioned symbol mark data and the current game lottery data set in the above-mentioned internal lottery processing (step S13), the CPU 33 controls the stepping motors 11A to 11C and decides a stop position.

Although the CPU 33 stops the stepping motors 11A to 11C in accordance with the current game lottery data, if decided that any one of the stop buttons 18A to 18C is depressed, the CPU 33 can apply an additional drive to the stepping motors 11A to 11C, under prescribed conditions. Specifically, when any symbol mark corresponding to the current game lottery data cannot be stopped and displayed, the stepping motors 11A to 11C are subject to an additional drive in the range of the maximum amount of four symbol marks. In this connection, if any symbol mark corresponding to the current game lottery data is not present in that range, it is impossible to stop and display any symbol mark corresponding to the current game lottery data. For instance, even when in the enabled prize-winning status, two drums are already stopped and there is a symbol mark(s) allowing for match with a winning pattern, whether the player obtains the winning pattern depends on the timing at which the player operates the stop button corresponding to the last drum to be stopped. On the other hand, when in the unabled prize-winning status, two drums are already stopped and there is a symbol mark(s) allowing for a winning pattern, the stepping motors 11A to 11C are controlled so as not to provide a match with the winning pattern, irrespective of the timing of operation of the stop button corresponding to the last drum to be stopped.

Upon completion of the above-mentioned stop control processing, the CPU 33 judges whether all the stop buttons 18A to 18C are depressed (step S17). In other words, in this processing of step S17, it is judged whether there are detected all the stop signals issued in accordance with the operation to the stop buttons 18A to 18C. In this connection, if judged that all of the stop buttons 18A to 18C are not operated, the CPU 33 returns the processing to step S15. If judged that all the stop buttons 18A to 18C are operated, the CPU 33 moves the processing to step S18.

Moving the processing of step S18, the CPU 33 judges whether a combination of symbol marks aligned on the line that becomes effective matches with a winning status, and performs processing of medal payout corresponding to the winning status. In this medal payout processing, if judged that the combination of symbol marks aligned in the effective line and the wining state are each matched, the CPU 33 calculates the number of payout medals corresponding to the winning status, and payouts a number of medals corresponding to the calculated number. Thereafter, the CPU 33 moves the processing to step S19. On the other hand, if judged that the combination of symbol marks aligned in the effective line and the wining state are not matched, the CPU 33 moves the processing to step S19, without executing any medal payout.

Moving the processing of step S19, the CPU 33 mainly performs processing for storing the current game lottery data (step S19). In this preferred embodiment, the processing for storing the current game result is terminated at the time that the CPU 33 reads the past game lottery data from the RAM 37 and stores the current game lottery data together with the past game lottery data in the RAM 37.

6. Flow of Operation of Game Machines

Figure 7:
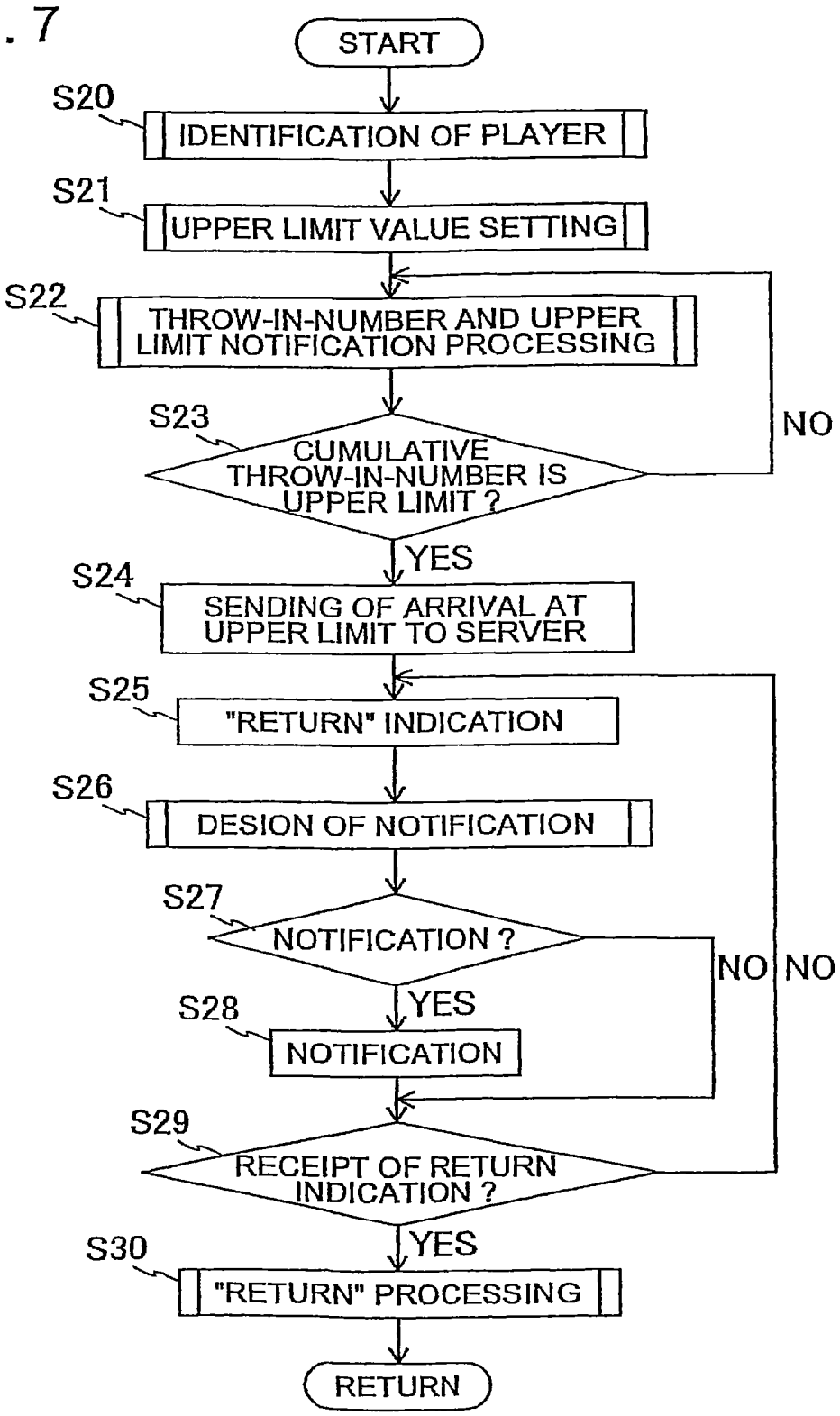
FIG. 7 is a flowchart showing the flow of operation of the game machine.

FIG. 7 is a flowchart showing the flow of operation of game machines. The procedure shown in this flowchart is performed concurrently with the subroutine of the game machines 2 shown in FIG. 6.

Referring to FIG. 7, the game machine 2 performs the processing for discriminating the player is performed (step S20). This processing (hereinafter referred to as "player discrimination processing") is executed by the CPU 33, in order to judge as to: i) whether a game is being performed on the game machine 2; ii) who the player is, if a game is performed on the game machine 2; and iii) whether he/she is the same or different from the previous player.

The reason why the player discrimination processing is particularly necessary is that payout return is executed per player in this preferred embodiment, unlike the conventional game machine executing payout return per game machine. That is, when there is a player change, the game (play) status about the upper limit till then is reset. It is therefore necessary to detect a player change and discriminate the player.

Figure 8:
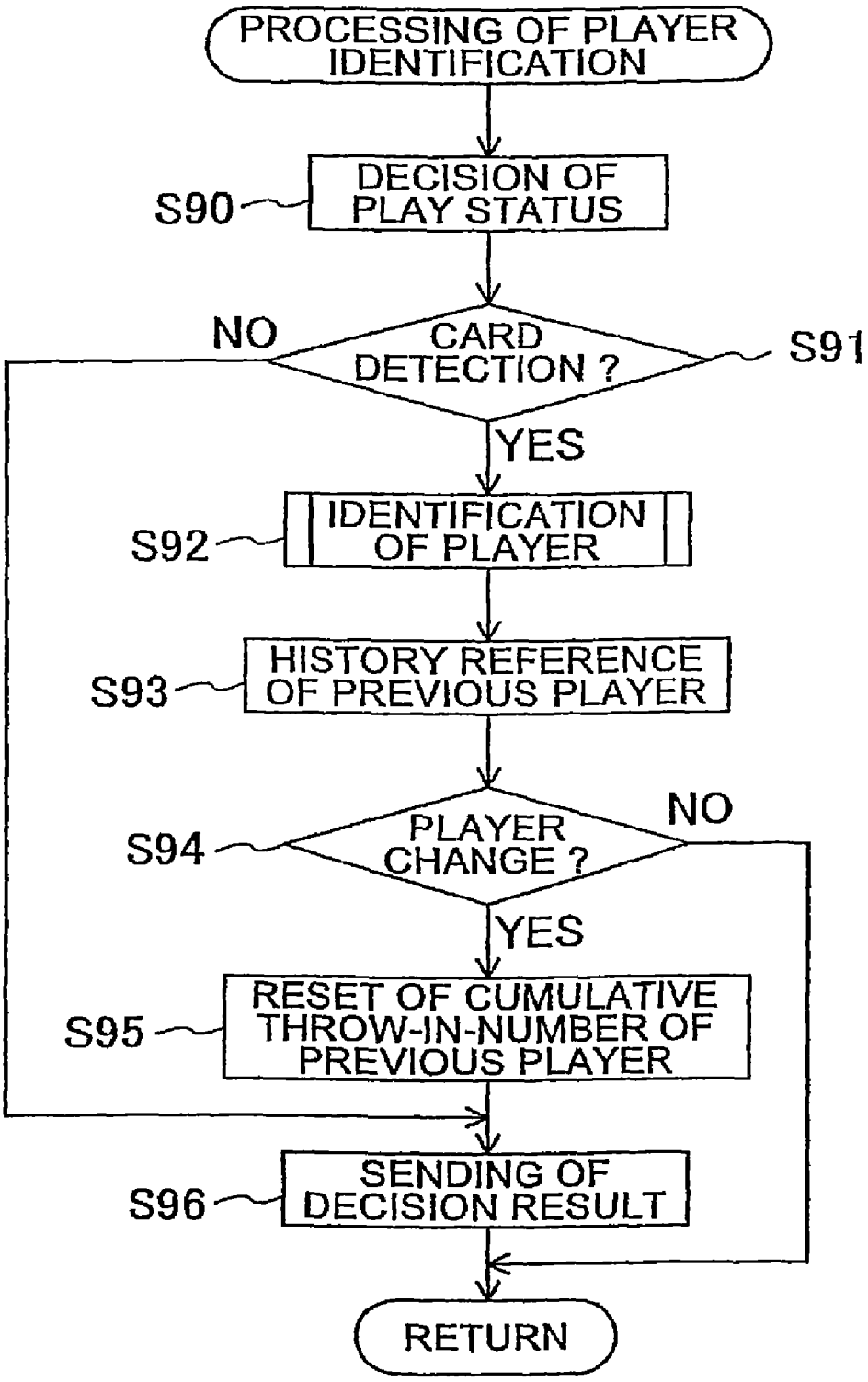
FIG. 8 is a flowchart showing the flow of operation of the game machine when performing a player identification process.

FIG. 8 is a flowchart showing the flow of operation of game machines when performing the player discrimination processing. The procedure in this flowchart corresponds to the subroutine of the player discrimination processing (step S20) shown in FIG. 7.

Referring to FIG. 8, firstly the CPU 33 of game machine 2 judges play status (step S90). The play status judgment is processing for judging whether there is a player performing a game on the game machine 2 (i.e., whether a game is being performed on the game machine 2). When the game machine 2 is not in play status, the following processing is unnecessary. It is therefore necessary to firstly check whether the game machine 2 is in play. The play status judgment is executed by detecting whether a card is inserted into the card inlet 22 provided on the front panel 4 of the game machine 2.

In order to check the play status, the CPU 33 judges whether a card is detected (step S91). This card detection is achieved by detecting whether a card is inserted into the card inlet 22 with the card reader 23. The card to be inserted is an identification card storing information to identify the player, which can have any function other than identification. For example, a prepaid card storing information to identify the player can be used.

In step S91, the card detection is performed. As the result, if judged that no card is inserted, the CPU 33 terminates the player discrimination processing. Thereafter, the CPU 33 of the game machine 2 sends the server 1 a signal of discrimination result that no card is detected (step S96). As the contents of signals related to the card detection, for example, data "0" is sent when no card is detected, and data "1" is sent when a card is detected.

If judged that a card is inserted, the CPU 33 performs processing for identifying the player performing a game on the game machine 2 (step S92). When a card is already inserted, the card reader 23 reads information stored in the card. In this preferred embodiment, the card inserted in the card inlet maintains identification number data individual to the player, in order to identify the player. Thereby, the CPU 33 of the game machine 2 can identify the player playing a game on the game machine 2, based on the identification number data.

Upon completion of the above-mentioned player identification processing, the CPU 33 refers to the previous player's history (step S93). Information of the players who have been played on the game machine 2 is stored, as history, in the RAM 37 of the game machines 2. The CPU 33 refers to the player's history stored in the RAM 37, and refers to the identification number of the player immediately before receiving a signal indicating that a card has been detected.

Based on the result of the above-mentioned references, the CPU 33 judges whether there is player change (step S94). Specifically, the CPU 33 compares i) the identification number data of the previous player that has been referred to in step S93; with ii) the identification number data of the player that has been sent from the card reader 23 together with the card detection signal, thereby judging whether there is agreement between the two. If the two data agree, the CPU 33 judges that there is no player change, because the same player merely inserted the identification card again. If the two data are different, the CPU 33 judged that there is player change. In the absence of no player change, the CPU 33 completes the player discrimination processing. In the presence of player change, the CPU 33 resets the cumulative throw-in number of the previous player (step S95). Specifically, the CPU 33 resets data related to the cumulative throw-in number of credit consumed by the previous player, in the player's history stored in the RAM 37 that has been referred to in step S93.

This reset processing is for implementing one of the characteristic features of the present preferred embodiment, that is, performing "payout return" per player. This means that the cumulative throw-in number of credit cannot be increased by addition to the credit number thrown by the other player. Therefore, if a certain player stops a game on one game machine before reaching the upper limit of the cumulative throw-in number of credit, and moves to the other game machine, this player will start a game on the other game machine from the status that the cumulative throw-in number of credit payout returns to "0". Thereby, the player might not often change game machines. In addition, the player is aware that there is a high probability of payout return when reaching the upper limit of the cumulative throw-in number. This makes possible to continue the game without anxiety.

Upon completion of the above-mentioned reset processing, the CPU 33 of the game machine 2 sends the result of judgment made in step S90 (step S96). Specifically, the CPU 33 sends the player's information to the server 1 via the communication interface circuit 41, network NT, and communication interface 53 of the server 1. Data to be sent may be the player's information to which value "1" is appended, as stated above. At this time, the past player's history information stored in the RAM 37 is rewritten with the new player's information and then stored by the CPU 33 of the game machine 2.

Upon completion of the above-mentioned data sending processing, the CPU 33 repeats the player discrimination processing.

Although in this preferred embodiment, an identification card storing data to verify the player or an ID card is employed as means for discriminating the player, the following means are applicable. For example, a human sensor to detect human body may be attached to the game machine 2. To a stool on which the player sits for performing a game, the function of weighing may be added for weighing and storing the player's body weight, thereby discriminating the player.

Referring again to FIG. 7, upon completion of the above-mentioned sequence of player discrimination processing, the CPU 33 of the game machine 2 performs processing for setting an upper limit value that is a standard for payout return (step S21). The upper limit value is the number of medals, as a game medium, which is used for performing a game on a slot game machine etc. When the number of medals used by a certain player reaches the upper limit value, the slot game machine executes payout return to this player.

The above-mentioned upper limit value setting is attainable in the following various instances: i) the upper limit setting is performed by using a preset upper limit value; ii) the owner of the game machine performs the upper limit setting; or iii) the upper limit value is automatically changed depending on the play status. The upper limit value setting executable in the above various instances should be performed when the game player of the game machine 2 is changed, and without failing to refer to the result of judgment whether there is player change in step S21. The result of judgment whether there is player change is made into data and sent from the server 1 to the game machine 2. Specifically, in the presence of player change, data to which value "1" is appended is sent. In the absence of player change, data to which value "0" is appended is sent.

Following is the instance of using a preset upper limit value, which is one of the above-mentioned various instances. The preset upper limit value is stored in the RAM 37. The CPU 33 reads data of the upper limit value from the RAM 37 and completes setting of the upper limit value. The instance of setting the upper limit value without using the preset upper limit value will be described hereafter.

Upon completion of the above-mentioned upper limit value set processing, the CPU 33 performs, based on the result of the bet button operation processing (step S11) shown in FIG. 6, processing for i) adding the number of medals thrown by the player as a game medium; and ii) notifying the upper limit (step S22).

A description of throw-in number addition processing will be presented here. A medal sensor (not shown) provided within the game machine 2 counts medals thrown in through the throw-in slot 15. The counted number data is added to a cumulative throw-in number data, which is data of medals thrown in the past, and stored as a current throw-in medal data Hereinafter, the cumulative consumption of credit is referred to as a "cumulative throw-in number of medals."

The above-mentioned cumulative throw-in number data is data stored in the RAM 37. The CPU 33 executes the following processing for: i) reading data of the past throw-in medal from RAM 37; ii) adding data of the current throw-in medal counted by the medal sensor to data of the cumulative throw-in number; and iii) storing the result of addition as updated cumulative throw-in number data in the RAM 37. The cumulative throw-in number data is reset in the presence of player change, as previously described in the player discrimination processing (step S20).

A description of upper limit notification processing will be next presented. The upper limit notification means to notify the player how soon the game machine 2 can reach the upper limit. Specific contents of the notification include: i) the set upper limit value; ii) the current cumulative throw-in number; or iii) the rate of the cumulative throw-in number to the upper limit value (i.e., one that is expressed by percentage how close to the upper limit).

By virtue of this notification, the player can check how long does it take to obtain payout return by performing a game. As the result, the player can continue the game without anxiety. For the reason for this, it may be preferable to provide the upper limit notification at any time. On the contrary, if it is far from the upper limit, the player might stop the game at that point. It is therefore necessary to construct such that the play status determines whether the upper limit should be notified or not.

In consideration of the foregoing circumstances, the upper limit notification is attainable in the following two manners: i) notification is executed at any time, or no notification is executed at any time (hereinafter referred to as a "first notification manner"); and ii) the play status determines whether notification should be executed or not (hereinafter referred to as a "second notification manner").

Following is the instance that takes the first notification manner performing notification at any time. The instance of taking the second notification manner will be described hereafter.

Upon completion of the above-mentioned throw-in medal number addition processing and upper-limit notification determination processing, the CPU 33 judges whether the cumulative throw-in number reaches the upper limit (step S23). This judgment is achieved by comparing i) the cumulative throw-in number data that was stored in the RAM 37 in step S22; and ii) the upper limit value that was set in step S21. Specifically, the CPU 33 compares these two data stored in the RAM 37 and judges whether the number of medals that the play throws in the game machine 2 reaches the upper limit. If judged that the cumulative throw-in number does not reach the upper limit value, the CPU 33 returns the processing to step S22, and continues processing for adding the number of medals that the player throws in the game machine 2. If judged that the cumulative throw-in number reaches the upper limit value, the CPU 33 sends the result (arriving at the upper limit) to the server 1 (step S24). Specifically, the CPU 33 of the game machine 2 sends i) a signal indicating that the cumulative throw-in number reaches the upper limit value; ii) data of the upper limit value set in step S21; and iii) data of payout return rate that will be described hereafter, to the server 1 via the communication interface circuit 41 of the game machine 2.

More specifically, the signal indicating arrival at the upper limit is expressed for example by numerical value of "1". To the signal indicating that the cumulative throw-in number reaches the upper limit, a signal designating the game machine 2 is appended (i.e., data indicating to which of plural game machines under the control of the server 1 the game machine 2 corresponds). For example, if an identification number, the numbers "123", is assigned to the game machine 2 among plural game machines under the control of the server 1, a signal of "123-1", wherein the numerical value "1" as the signal indicating arrival at the upper limit is affixed to the identification number "123" of the game machine 2, is sent to the sever 1.

The upper limit value data is stored in the RAM 37, as described above. This upper limit value data is used for determining the number of payout return medals on the occasion where payout return must be executed to the player. The number of payout return medals is calculated by multiplying the upper limit value by a payout return rate.

The RAM 37 of the game machine 2 stores data about the payout return rate used in determining to what extent payout return must be executed with respect to the upper limit value of the game machine 2. This payout return rate data is sent from the game machine 2 to the server 1.

The above-mentioned payout return rate is usually a preset numerical value. It is however possible to change the payout return rate in various forms, thereby increasing the game characteristics.

Upon completion of the upper-limit-arrival result sending processing to the server 1, the CPU 33 waits for a payout return instruction (step S25). The payout return instruction is a signal to be sent from the server 1 to the game machine 2 of which cumulative throw-in number data reaches the upper limit, and this signal is used for controlling the timing of payout return etc. The game machine 2 becomes enabled for play even while waiting for the payout return instruction.

In the above-mentioned payout return instruction waiting status, the CPU 33 performs processing for judging whether notification should be executed or not (step S26). The term "notification" means to notify that payout return will be executed from now to the player of the game machine 2.

By referring to the data stored in the RAM 37, the CPU 33 determines as to whether this notification should be executed (step S27). The RAM 37 stores data for determining execution of notification. Specifically, data of "1" is assigned for execution of notification, and data of "0" is assigned for no execution of notification. These data may be preset or set properly by the owner of the game machine etc.

When the data stored in the RAM 37 is "1", the CPU 33 notifies the player the content that the cumulative throw-in medal number of the game machine 2 on which he/she is performing a game will reach the upper limit thereby to execute payout return shortly (step S28). This notification may be executed by using an illuminator provided within the game machine 2. Alternatively, the game machine 2 may have a display part performing notification to the player. Any notification means capable of giving the player a previous notice of payout return may be employed, whether it be provided unitary with the game machine 2.

When the above-mentioned notification processing is completed, or when judged no notification is executed, the CPU 33 judges whether a payout return instruction is received (step S29). This payout return instruction is one that the game machine 2 waits for its arrival from the server 1 in step S25. The server 1 sends this payout return instruction without fail to a game machine constructed so as to receive payout return every time it reaches the upper limit, as well as a game machine constructed such that payout return is not always executed when it reaches the upper limit.

The server 1 sends a payout return instruction signal at a predetermined timing to the game machine 2 via the communication interface 53. In the game machine 2, the CPU 33 receives the payout return instruction via the communication interface circuit 41 and input/output bus 32. If failed to receive the payout return instruction, the CPU 33 returns the processing to step S25, and waits for the payout return instruction again.

Upon completion of the above-mentioned payout return instruction receiving processing, the CPU 33 executes return processing (step S30). This payout return processing is executed based on the payout return instruction issued from the server 1 in step S29. Specifically, the CPU 33 receives data that indicates to what extent payout return should be executed to the game machine 2, and executes payout return based on the received data.

In the game machine receiving payout return every time the throw-in medal number reaches the upper limit, payout return is executed by the amount of medals calculated mainly based on the upper limit data and payout return rate data stored in the RAM 37. On the other hand, in the game machine wherein payout return is not always executed when the throw-in medal number reaches the upper limit, if decided to execute no payout return, the CPU 33 performs processing for resetting the throw-in number data stored in the RAM 37, as required. This throw-in number data reset is executed under a program stored in the ROM 36 on receipt of an instruction of the CPU 33.

Upon completion of the above-mention payout return processing, the CPU 33 moves again the processing to the upper-limit value setting processing (step S21), and repeats the above-mentioned sequence of processing.

7. Flow of Return Preparation Operation of Game Server

Figure 9:
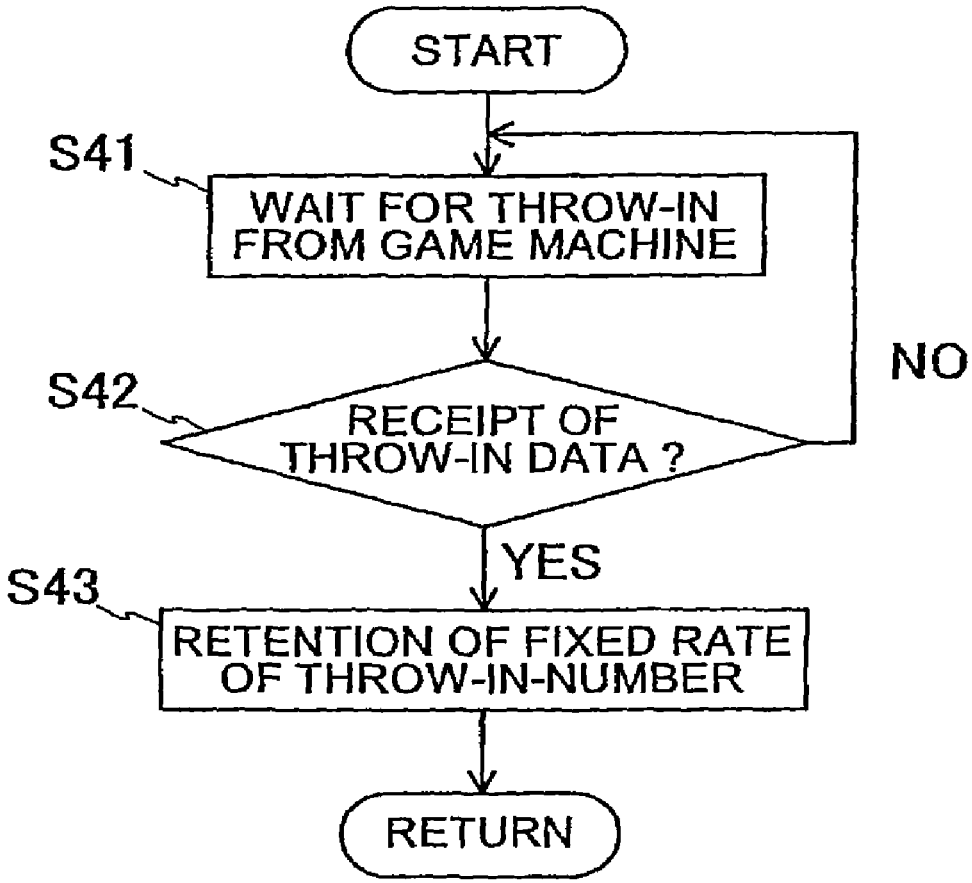
FIG. 9 is a flowchart showing the flow of operation when the game server makes preparation for payout return.

FIG. 9 is a flowchart showing the flow of operation when the game server makes preparation for payout return. This operation is always repeated in the server 1.

The server 1 always holds some of medals serving as a game medium, which have been thrown in each game machine 2, in preparation for execution of payout return to the game machine 2 under the control of the server 1 reaches the upper limit.

Referring to FIG. 9, the server 1 is waiting for the game medium throw-in result from each game machine 2 (step S41).

As the game medium that the player uses on each game machine 2, it is possible to use any tangible matters, e.g., medals, winning balls, or coins, each being used generally. Besides these, any intangible matters that can be expressed in numerical value as data are also handled as a game medium in this preferred embodiment. The term "throw-in" means the following action that a certain player makes a game machine recognize the game medium for the purpose of playing a game, irrespective of the type of the game medium. Therefore, not only a medal etc. that is thrown in through the throw-in slot 15 and detected by the medal sensor of the game machine 2, but also numerical value data etc. that the player decides to use for game becomes a candidate for wait.

In the status that the server 1 is waiting for throw-in of a game medium, the CPU 51 of the server 1 judges whether game medium throw-in data is received at a predetermined timing (step S42). In this preferred embodiment, medals are used as the game medium, and the player continues the game on the game machine 2, while throwing in medals via the throw-in slot 15. These thrown-in medals are subjected to the following processing: i) the number of these medals is detected by the medal sensor within the game machine 2; and ii) the detected number is made into a numerical value as data, and then stored in the RAM 37 of the game machine 2, as cumulative throw-in number data. This cumulative throw-in number data is sent at a predetermined timing to the server 1 via the communication interface circuit 41. The server 1 receives this cumulative throw-in number data via the communication interface 53. The received cumulative throw-in number data is properly stored in the memory 52, based on an instruction of the CPU 51. In the judgment processing in step 42, if the server 1 fails to receive the throw-in data, the CPU 51 returns the processing to step S41.

Upon completion of the throw-in data receiving judgment processing, the CPU 51 holds a predetermined percent of the throw-in number (step S43). As stated above, the server 1 is constructed so as to hold in advance the game medium for payout return to the player performing a game on each game machine 2 under the control of the server 1. The hold amount differs from one server to another. The hold amount is determined by multiplying the cumulative throw-in number data of each game machine 2 that is received in the throw-in data receiving judgment processing (step S42), by a predetermined rate (payout return rate).

In the above-mentioned hold processing, the server 1 sends a numerical value data corresponding to the hold amount calculated by the CPU 51, to the game machine 2 via the communication interface 53. In the game machine 2, the CPU 33 stores in the RAM 37 the numerical value data that is part of the cumulative throw-in number data, as hold data.

Upon completion of the above-mentioned hold processing, the server 1 returns to the status of waiting for throw-in data from each game machine 2 (step S41), and repeats the foregoing sequence of processing.

8. Flow of Return Operation of Game Server

Figure 10:
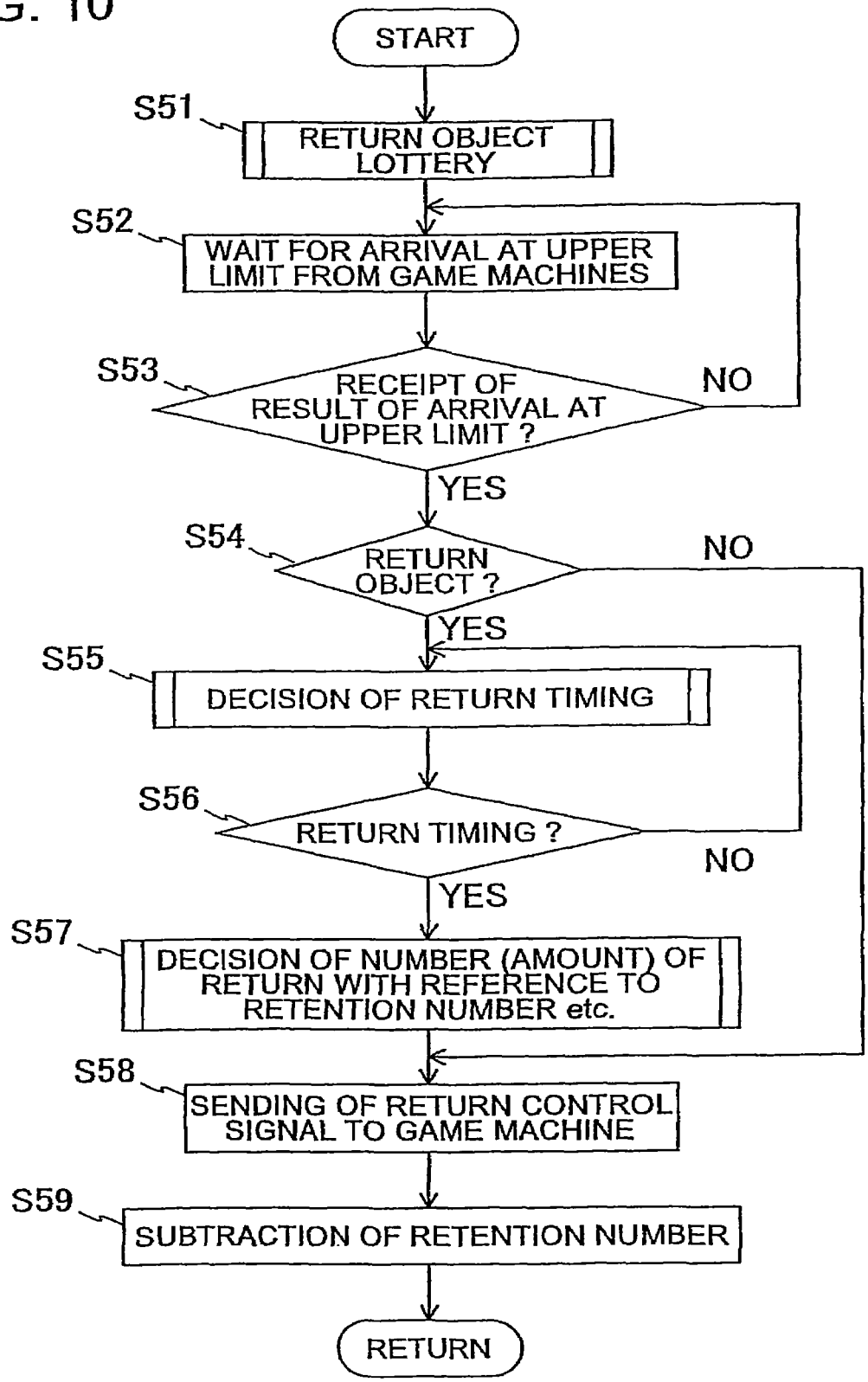
FIG. 10 is a flowchart showing the flow of operation when the game server executes payout return.

FIG. 10 is a flowchart showing the flow of operation when the game server executes payout return. This operation is always repeated.

Referring to FIG. 10, firstly, the CPU 51 of the server 1 performs processing for selecting a payout return destination by lottery (step S51). This payout return destination lottery is mainly performed to the instance that payout return is not necessarily executed to the game machine 2 reaching the upper limit. As the lottery manner, there are for example: i) "payout return is executed to a game machine that will be the N-th to reach the upper limit"; and ii) "payout return is executed to a game machine, the last number of which serial machine number is matched with a lottery number." Whereas in the instance that payout return is always executed to the game machine reaching the upper limit, the result obtained by lottery can be exemplified as follows: i) "payout return is executed to a game machine that will be the fast to reach the upper limit; and ii) "payout return is executed to game machines, the last number of which serial machine number is 0, 1, . . . 9 (i.e., to designate all the serial machine numbers)." These lottery results are stored in the memory 52, based on an instruction of the CPU 51.

Upon completion of the above-mentioned payout return destination lottery processing, the CPU 51 enters the state of waiting for the upper limit arrival result sent from each game machine 2 (step S52). As stated above, this upper limit arrival result indicates that the game medium thrown in the game machine 2 reaches a preset amount. Upper limit arrival judgment is made on the game machine 2. In case of reaching the upper limit, this result is sent to the server 1 waiting for the upper limit arrival result via the communication interface 53.

When the server 1 is waiting for the upper limit arrival result, the server 1 performs judgment of the receipt of the upper limit arrival result at a predetermined timing (step S53). The CPU 51 executes this judgment. If judged that the upper limit arrival result is received, the CPU 51 moves the processing to the step S54. If judged no upper limit arrival result is received, the CPU 51 returns to the upper limit arrival result wait processing (step S52), and repeats judgment of the receipt of the upper limit arrival result at the predetermined timing.

Moving the processing of step S54, the CPU 51 judges whether the game machine 2 sending the upper limit arrival result is a payout return destination. This judgment is executed, based on the data determined by the lottery performed in the above-mentioned payout return destination lottery processing (step S51). Thus, the judgment is achieved by performing the following processing: i) referring to the data stored in the memory 52; and ii) comparing this reference data with data affixed to the upper limit arrival result.

Say for example the lottery result that "payout return is executed to a game machine, the last number of which serial machine number is matched with a lottery number," as described above, the CPU 51 reads data of the identification number of the game machine 2 that is affixed to the above lottery result, and then judges whether the last number of the identification number is matched with the above lottery number. In the instance that payout return is always executed for the upper limit arrival, a positive result is always obtained in the judgment whether it is the payout return destination.

In the above-mentioned payout return destination judgment processing, if judged as not being payout return destination, a signal indicating no execution of payout return is sent in the processing for sending a payout return control signal that will be described later. This signal is sent to the game machine 2 via the communication interface 53, based on an instruction of the CPU 51. If obtained a positive result, the CPU 51 performs processing for judging a payout return timing (step S55).

The payout return timing can be set variously. For example, to the game machine reaching the upper limit and being the corresponding payout return destination, forced payout return may be executed immediately after completing all the processing on the server. Alternatively, payout return may be executed after an elapse of a predetermined period of time from the completion of all the processing on the server, or after performing a predetermined number of games.

The processing for judging a payout return timing is to judge at which timing payout return should be executed. If a payout return timing is predetermined uniquely, this payout return timing is employed.

Upon completion of the above-mentioned payout return timing judgment processing, the CPU 51 judges whether a payout return timing is established (step S56). The term "payout return timing" is one that is determined in the payout return timing judgment processing (step S55), this payout return timing is stored in the memory 52 of the server 1. For instance, if provided a temporal timing such as "at a few minutes after the upper limit arrival," a timer (not shown) within the server 1 is used to control this timing. If provided a timing based on the player's game circumstances such as "when the player performs twenty games after reaching the upper limit," various sensors within the game machine 2 are used to judge whether predetermined conditions are satisfied, and a signal is sent from the CPU 33 of the game machine 2 so that the server 1 is informed of this timing.

If judged that a payout return timing after which the processing for payout return starts is not established, the CPU 51 returns the processing to step S55, and repeats the processing from step S55. If judged a payout return timing is established, the CPU 51 performs processing for determining the amount of payout return by referring to the hold game medium amount (number) etc. obtained in step S43, as shown in FIG. 9 (step S57).

The hold game medium in the hold processing shown in FIG. 9 (step S43) is devoted to the amount of payout return to the game machine 2. Arriving at the upper limit, payout return is usually executed by multiplying the upper limit by a preset payout return rate. As a general rule, the server 1 calculates the payout return amount based on the upper limit data and payout return rate data that are contained in the upper limit arrival result sent from the game machine 2. On the other hand, as the result of the above-mentioned payout return timing lottery, if there is a prolonged period of time between the upper limit arrival and execution of payout return, the player waits for payout return while performing a game. Therefore, it can be considered to increase the payout return amount depending on the credit number consumed after reaching the upper limit. For the purpose of this, the server 1 can increase the payout return amount somewhat or increase the payout return rate in consideration of the credit number consumed after reaching the upper limit, in the payout return amount determination processing (step S57).

It can also be considered to change the payout return rate depending on the upper limit value, in order to produce higher game characteristics. In this instance, without using a predetermined payout return rate, the payout return rate should be changed depending on the result of lottery that is performed on the server 1 under the collective control of plural game machines 2.

A manner of producing higher game characteristics by changing the payout return rate will be presented hereafter.

Upon completion of the above-mentioned payout return amount determination processing, the CPU 51 sends a payout return control signal to the game machine 2 (step S58). This payout return control signal can be classified into two types, according to the result of the above-mentioned payout return destination judgment processing (step S54). Specifically, the value of "1" is given to the game machine judged as being the payout return destination in the above-mentioned payout return destination judgment processing (step S54). Hence, this value of "1" is data indicating that this game machine is the payout return destination is affixed to part of the payout return control signal. On the other hand, the value of "0" is given to the game machine judged as not being the payout return destination. Hence, the value of "0" is data indicating that this game machine is not the payout return destination is affixed to part of the payout return control signal. In the instance that payout return is always executed to the game machine reaching the upper limit, the value of this payout return control signal may be set to "1".

A payout return control signal contains data for determining the degree of payout return (the payout return amount). All the data contained in this payout return control signal are sent to the server 1 via the communication interface circuit 41 and communication interface 53, based on an instruction of the CPU 33 of the game machine 2.

Upon completion of the above-mentioned control signal sending processing, the server 1 subtracts a hold number (step S59). The term "hold number" means the amount of game medium held in the memory 52 of the server 1. This hold game medium is used for payout return to each game machine 2. It is therefore necessary to perform subtraction of the game medium amount data corresponding to the payout return amount.

The CPU 51 executes this hold amount subtraction processing, and the game medium amount data in the memory 52 is updated after this subtraction processing.

In the instance that the payout return amount to the game machine 2 is changed depending on the play status, it can be constructed as follows: when the payout return to the game machine 2 is completed, the CPU 33 of the game machine 2 sends the server 1 data indicating the payout return amount to the player performing a game on this game machine 2, and the subtraction processing is performed when this data is received.

Upon completion of the above-mentioned hold amount subtraction processing, the CPU 51 of the server 1 returns the processing to step S51, and repeats the processing from the step of payout return destination lottery.

9. Flow of Upper Limit Setting Processing

The upper limit can be set by a method of using a predetermined upper limit value, or a method of using the upper limit value determined by lottery on the server etc. Since the former method is already described, the latter method will be presented hereafter.

Figure 11:
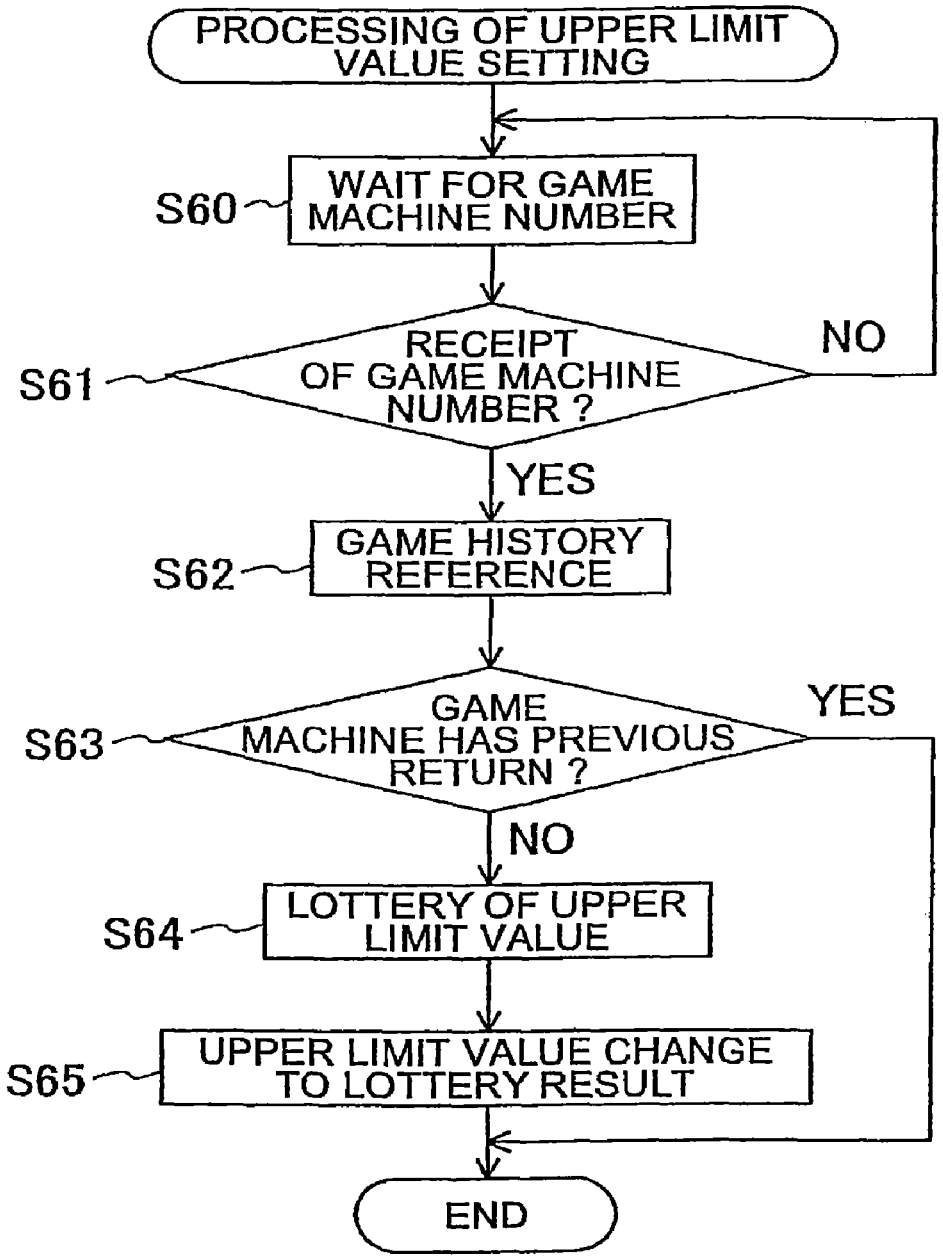
FIG. 11 is a flowchart showing the flow of operation when the game server sets an upper limit value.

FIG. 11 is a flowchart showing the flow of operation when the game server sets the upper limit value. This flowchart corresponds to the subroutine of the upper limit value setting processing shown in FIG. 7 (step S21).

The server 1 enters the state of waiting for a game machine serious number assigned to each game machine 2 under the control of the server 1 (step S60).

As previously described, the server 1 controls the game machine group consisting of plural game machine 2. It is therefore necessary to discriminate one game machine trying to set the upper limit value from the plural game machines. The game machine 2 trying to set the upper limit value sends, based on an instruction of the CPU 33 of this game machine 2, its machine serial number to the server 1 via the communication interface circuit 41, network NT, and communication interface 53 of the server 1.

As used herein, the game machine trying to set the upper limit value can be classified into: i) the game machine on which the presence of player change is judged in the player discrimination processing (step S20); and ii) the game machine reaching the upper limit set previously. The game machine serial number data is sent together with i) a signal indicating player change; and ii) the player's information data. That is, the upper limit value setting to the game machine 2 is executed i) when there is player change; or ii) when reaching the upper limit set previously.

When the server 1 enters the state of waiting for a game machine serial number assigned to each game machine 2, the CPU 51 judges whether a game machine serial number is received (step S61). If judged that no game machine serial number is received, the CPU 51 returns the processing to step S60, and waits it again. If judged that a game machine serial number is received, the CPU 51 refers to a game history (step S62).

As stated above, the flow of the upper limit value setting processing corresponds to the subroutine of step S21 shown in FIG. 7. Therefore, the game machine 2 may be subjected to the processing of step S21 for the first time, or come to again step S21 after going through the payout return processing (step S30).

The game history reference is to know how the game machine 2 reaches the upper limit value setting processing (step S21). This is also to prevent the dual change of the upper limit value at which the game machine 2 has not yet arrived, because it is possible to set the upper limit after execution of payout return, which will be presented hereafter.

The game history is stored in the database 54 of the server 1, and the CPU 51 of the server 1 executes its reference processing. This game history stores: i) the past upper limit values; and ii) data indicating whether payout return has been executed (payout return history data).

Refer of the game history, the CPU 51 judges whether payout return has been executed to the game machine 2 at the previous upper limit arrival (step S63).

Data indicating whether payout return has been executed is stored in the column of "the past execution of payout return" in the above-mentioned payout return game history data. Specifically, in the presence of payout return, data of "1" is given to this column, whereas in the absence of payout return, data of "0" is given to this column.

If payout return is executed after the previous upper limit arrival, the CPU 51 judges that a new upper limit value has been set thereafter, and completes the upper limit value setting processing. If judged that no payout return has been executed after the previous upper limit arrival, the CPU 51 determines an upper limit value by lottery (step S64). This upper limit value lottery is executed by selecting at random one from a certain range of numerical values (e.g., 1 to 200), under a program for upper limit value lottery stored in the memory 52. These numerical values are expressed in thousands of yen. For example, when "10" is selected by lottery, the upper limit value is ten thousand yen (¥10,000).

Without limiting to an amount of money, the upper limit value may be represented by for example i) the number of medals that can regarded as a game medium; ii) play time; or iii) frequency in play.

Upon completion of the above-mentioned lottery processing, the server 1 changes the upper limit value to the lottery result (step S65). This upper limit value change is executed by storing, under the control of the CPU 51, the new upper limit value in the column of "the upper limit" in the game history of the database 54. This upper limit value is also sent to the game machine 2.

Consider now the instance that the upper limit value is set after a predetermined payout return is executed.

Figure 12:
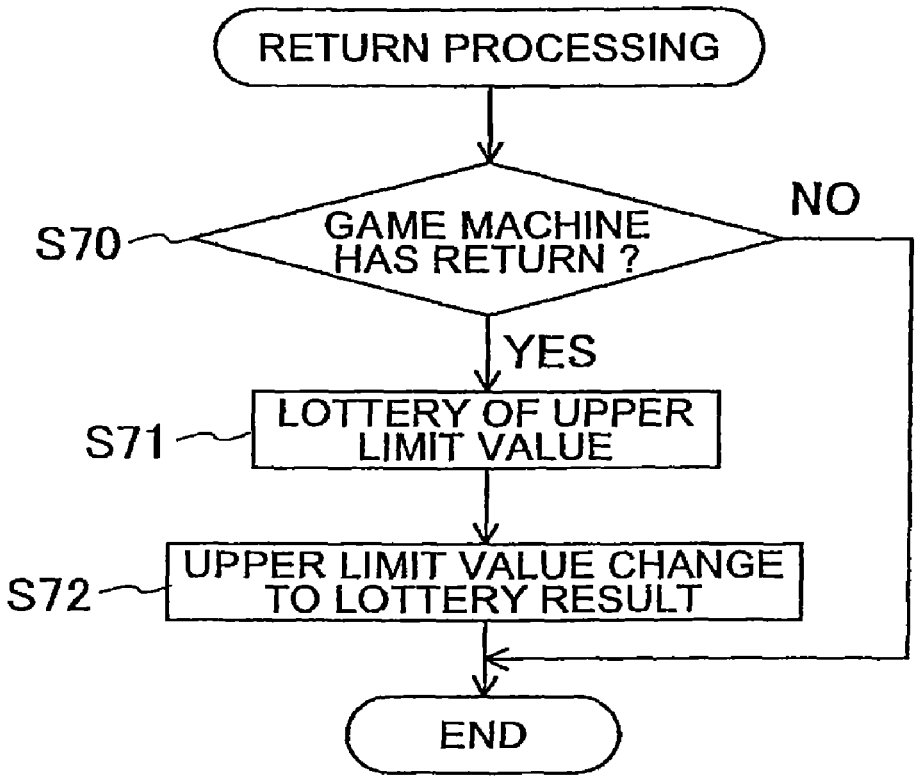
FIG. 12 is a flowchart showing the flow of operation when the game server sets an upper limit value after executing a predetermined payout return.

FIG. 12 is a flowchart showing the flow of operation when the game server sets the upper limit value after executing a predetermined payout return. This flowchart corresponds to the subroutine of the payout return processing shown in FIG. 7 (step S30). That is, the upper limit value setting after executing payout return is included in the processing of step S30, as a payout return processing.

Referring to FIG. 12, the server 1 firstly judges whether payout return is executed to the game machine 2 (step S70). The presence or absence of payout return is recorded (stored) in the above-mentioned payout return history. Specifically, data of "1" in the column of "the past payout return" of the payout return history indicates that payout return has been executed, whereas data of "0" indicates that no payout return has been executed. The CPU 51 of the server 1 makes a judgment as to whether payout return has been executed. If judged that no payout return has been executed, in the upper limit value setting processing shown in FIG. 7 (step S21), the upper limit value is set based on the subroutine shown in FIG. 11, and therefore the CPU 51 terminates the processing. On the other hand, if judged that payout return has been executed, the CPU 51 determines the upper limit value by lottery (step S71). This upper limit value lottery is executed by selecting at random one from a certain range of numerical values under a program for upper limit value lottery stored in the memory 52.

Upon completion of the above-mentioned upper limit value lottery processing, the server 1 performs processing for changing the upper limit value to the lottery result (step S72). This upper limit value change is achieved by storing the new upper limit value in the column of "the upper limit" of the game history of the database 54. This upper limit value is also sent to the game machine 2.

Executing the foregoing sequence of processing terminates the processing of the upper limit value setting after execution of payout return.

Further, the upper limit value setting can be executed after the player moves to an advantageous status (i.e., after obtaining a big prize (big bonus)).

Figure 13:
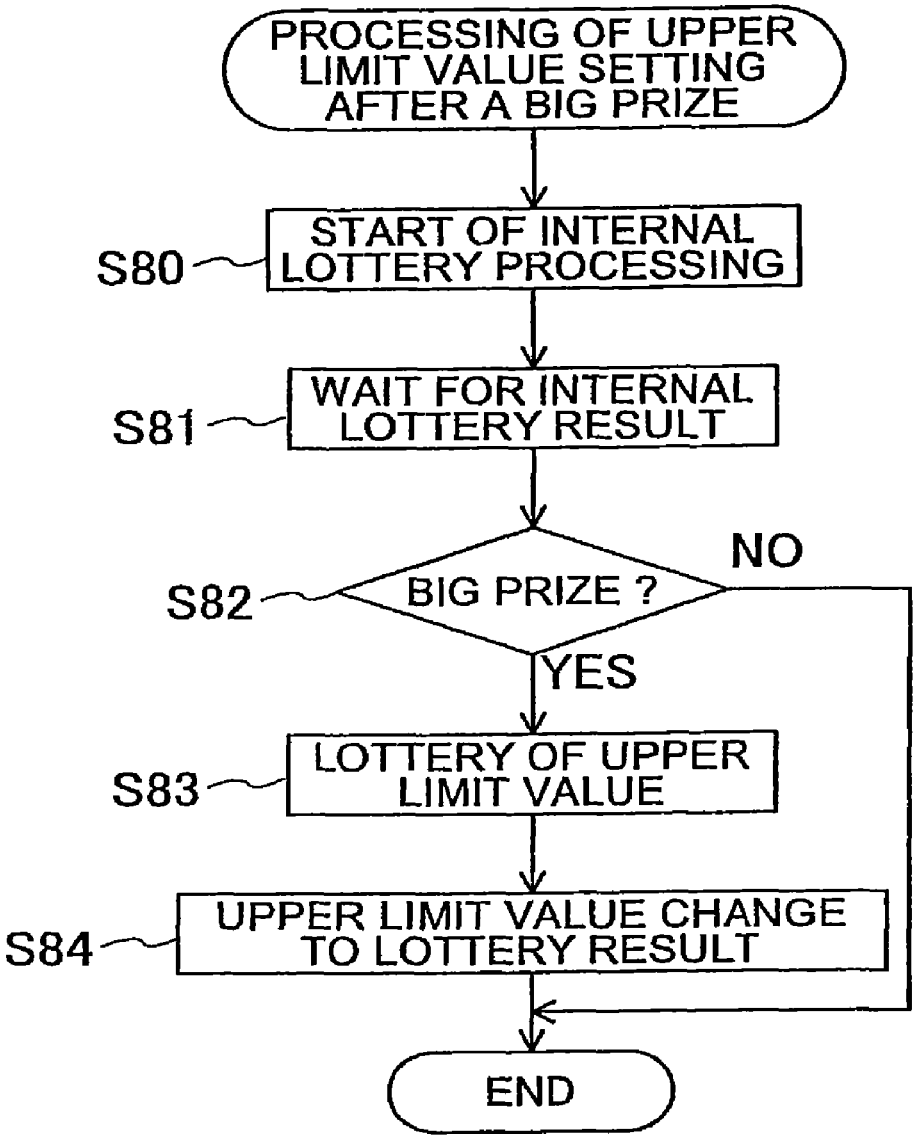
FIG. 13 is a flowchart showing the flow of operation when the game server sets an upper limit value after a game machine is subject to a big prize.

FIG. 13 is a flowchart showing the flow of operation when the game server sets the upper limit value after a big prize occurs on the game machine. This flowchart corresponds to the subroutine of the internal lottery processing shown in FIG. 6 (step S13). Although, for convenience in illustration, the flowchart of FIG. 13 is started with the internal lottery processing (step S80), this internal lottery processing will be performed in each game machine 2. Therefore, step S81 and later processing are the operation of the server 1.

Referring to FIG. 13, when the internal lottery processing is started, the CPU 51 of the server 1 enters the state of waiting for the internal lottery result (step S81).

When the internal lottery result is sent from the each game machine 2, the CPU 51 judges whether this result is a big prize (step S82). In step S82, if judged it is not a big prize, the CPU 51 terminates this processing. On the other hand, if judged it is a big prize, the CPU 51 executes the upper limit lottery (step S83). This upper limit value lottery is executed by selecting at random one from a certain range of numerical values under a program for upper limit value lottery stored in the memory 52.

Upon completion of the above-mentioned upper limit value lottery processing, the server 1 changes the upper limit value to the lottery result (step S84). This upper limit value change is achieved by storing the new upper limit value in the column of "the upper limit" of the game history of the database 54. This upper limit value is also sent to the game machine 2.

Executing the foregoing sequence of processing terminates the processing of the upper limit value setting after a big prize.

As discussed above, the game machine producing higher game characteristics to the player can be provided by properly changing the upper limit value that is a standard for payout return. In the game machine constructed so as to notify the degree of upper limit, the next following upper limit value is clearly displayed to the player, thereby enabling to perform a game without anxiety. In addition, if the next upper limit value is set at a high value, the player can judge whether he/she desires to continue the game.

10. Flow of Notification Judgment Processing

The term "notification" in the notification judgment processing shown in FIG. 6 (step S26) means to notify the player that i) game media (e.g., the number of medals) thrown in the game machine 2 reaches the upper limit; or ii) how many throw-in medals is necessary for reaching the upper limit (In order words, a gap to the upper limit).

This notification is achieved with the following method that the amount necessary for reaching the upper limit value is indicated by the digital score indicator 19 disposed on the front panel 4 of the game machine 2. For instance, assuming that the number of medals represents the upper limit value, the player will be notified in the following manners. When indicating a gap to the upper limit, the number of medals insufficient for the upper limit is flashing on and off the display of the score indicator 19. When indicating the upper limit arrival, an indication is also flashing on and off the display of the score indicator 19. Although in this preferred embodiment, the digital score indicator is employed as notification means, for example, a crystal liquid display for indication may be attached to the front panel 4. In this instance, it is preferable to produce more effective indication of the upper limit arrival on the liquid crystal display. As an example of representation, an expressive character appears on the display.

Although the instance of indicating the number of medals insufficient for the upper limit will be presented hereafter, without limiting to this, any indication manner may be employed which is capable of indicating apparently a gap between the upper limit and credit cumulative consumption. There are for example the following manners of: i) indicating both of a predetermined upper limit value and credit cumulative consumption; and ii) indicating a gap to the upper limit by a rate of credit cumulative consumption to a predetermined upper limit (i.e., one that expresses the degree of cumulative consumption in percentage).

Figure 14:
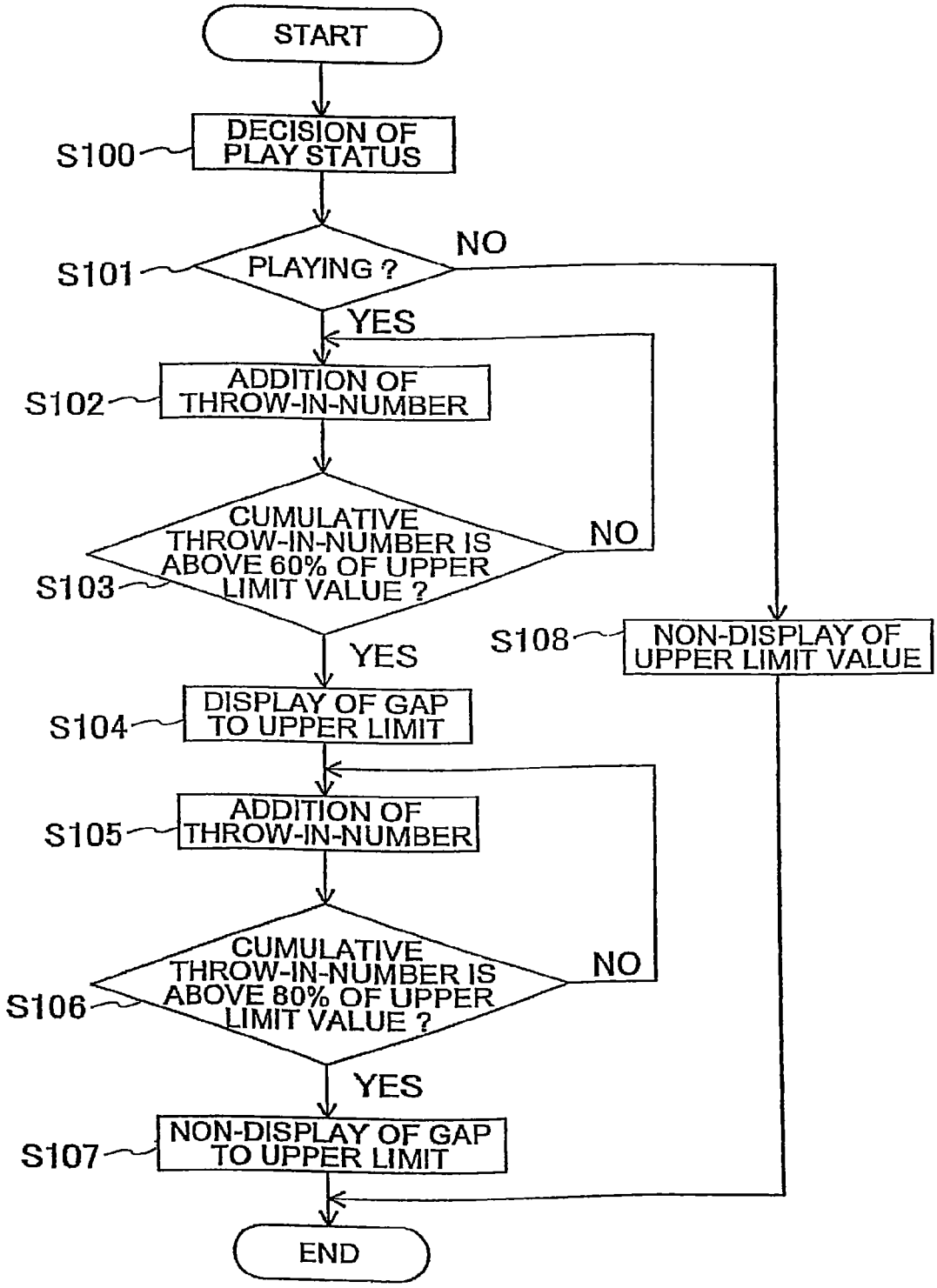
FIG. 14 is a flowchart showing the flow of operation when making a decision of notification.

FIG. 14 is a flowchart showing the flow of operation when making a judgment of notification.

The server 1 judges as to whether a notification having contents as described above should be executed to a certain game machine 2, on the basis of the fact that a game is being performed on this game machine 2. In other words, if a game machine on which no game is being performed receives such a notification that there is an extremely large gap to the upper limit on this game machine, a certain player who is going to perform a game on this game machine may, in all probability, give up the game due to this notification. Accordingly, the changeover between indication and non-indication of notification aims at avoiding the above situation and producing higher game characteristics.

Referring to FIG. 14, the server 1 firstly judges a play status of the game machine 2 (step S100). This play status judgment is achieved by detecting whether a card is inserted in the card inlet 22 disposed in the game machine 2. As stated above, this card may be an identification card storing the player's personal information, or a prepaid card etc. in order to purchase a certain amount of game medium before performing a game. This preferred embodiment will be described as applied to the instance of using the above-mentioned identification card.

A card reader 23 for detecting a card insertion is provided in the game machine 2. Specifically, the ROM 36 stores a program to be executed according to an instruction of the CPU 33. Under this program, it is judged that a game is being performed if the card reader 23 detects a card, and that no game is performed if the card reader 23 detects no card.

In this manner, using the card reader 23 judges whether the game machine 2 is in play (step S101). As described above, a card will be detected if the game machine 2 is in play, and no card will be detected if not in play. The CPU 33 of the game machine 2 executes this card detection. This card detection result (a card detection signal) is sent to the server 1 via the communication interface circuit 41, network NT, and the communication interface 53 of the server 1. As a card detection signal, the value of "1" is sent as data when a card is detected, and the value of "0" is sent as data when no card is detected.

Upon completion of the above-mentioned card detection processing, the server 1 reads the player's information and adds the game medium throw-in number (step S102). The number of medals as a game medium is, as described above, a standard for judging whether the upper limit value should be indicated. The medal sensor in the vicinity of the throw-in slot 15 of the game machine 2 detects throw-in medals, and the detected throw-in number is stored in the RAM 37 according to an instruction of the CPU 33. The past throw-in number data is stored in the RAM 37. The CPU 33 reads this data and adds the current throw-in number thereto, thereby updating the throw-in number data. This updated throw-in number data is stored in the RAM 37. At a predetermined timing, the cumulative throw-in number data stored in the RAM 37 is sent to the server 1 via the communication interface circuit 41, network NT, and the communication interface 53 of the server 1. The sent data is stored in the memory 52, based on an instruction of the CPU 51.

The CPU 33 of the game machine 2 performs processing for adding the game medium throw-in number, to obtain data indicating its cumulative throw-in number. Receive of this data, the server 1 judges whether the cumulative throw-in number reaches 60% or more of the upper limit value (step S103).

As used herein, the expression "60% or more of the upper limit value" is a standard amount for judging whether a gap to the upper limit on a game machine 2 should be displayed on the display part 19 of this game machine 2. The numerical value of "60%" is for purposes of illustration only and is not to be constructed as a limiting value. It is however preferred to use at least a numerical value of slightly exceeding half the upper limit, in view of the player's psychological lift.

Judgment whether the cumulative throw-in number reaches 60% or more of the upper limit value is made by the CPU 33 of the game machine 2. If the CPU 33 judged that the cumulative throw-in number does not reach 60% or more of the upper limit value, the game machine 2 returns the processing to step S102, and performs processing for adding the number of throw-in game media (corresponding to medals in this preferred embodiment). On the other hand, if judged that it reaches the 60% or more, the game machine 2 displays the amount insufficient for the upper limit (step S104).

As used herein, the expression "the amount insufficient for upper linit" is for indicating how many throw-in medals are required to reach the upper limit value that has been set in step S21 (see FIG. 6). Processing for indicating the amount insufficient for upper limit is executed under a program stored in the ROM 36, based on an instruction of the CPU 33. Specifically, there is calculated the amount insufficient for upper limit (i.e., a numerical value to be calculated by subtracting the cumulative throw-in number from the upper limit value), and this numerical value is displayed on the display part 19 of the game machine 2.

By executing the foregoing processing, the player performing a game on a certain game machine is unaware of a gap to the upper limit on this game machine from the beginning of the game to the arrival at a predetermined status. The player will therefore continue playing the game with excitement, thereby providing the game machine of high game characteristics.

Upon completion of the above-mentioned processing for displaying the amount insufficient for upper limit, the game machine 2 adds the next game medium throw-in number (step S105).

The number of medals as a game medium is a standard for judging whether the upper limit value should be displayed. The medal sensor of the game machine 2 detects throw-in medals, and data of this throw-in number is stored in the RAM 37 according to an instruction of the CPU 33. The CPU 33 executes the following processing for: i) reading the past throw-in number data stored in the RAM 37; ii) adding the current throw-in number to update this data; and iii) directing the RAM 37 to store the updated data. The cumulative throw-in number data stored in the RAM 37 is sent to the server 1 at a predetermined timing. The sent data is stored in the memory 52 based on an instruction of the CPU 51.

The CPU 33 of the game machine 2 performs processing for adding the game medium throw-in number, to obtain data indicating its cumulative throw-in number. Receive of this data, the server 1 judges whether the cumulative throw-in number reaches 80% or more of the upper limit value (step S106).

As used herein, the expression "80% or more of the upper limit value" is a standard amount for judging whether the "display status" of the gap to the upper limit on a game machine 2, which has been effected on the display part 19 of this game machine 2 in the above-mentioned processing for displaying the amount insufficient for upper limit (step S104), should be changed to the "non-display status." The numerical value of "80%" is for purposes of illustration only and is not to be constructed as a limiting value. In view of the player's psychological rise, it is preferred to use such numerical values giving the player the impression that it is short way to the upper limit.

Judgment whether the cumulative throw-in number reaches 80% or more of the upper limit value is made by the CPU 33 of the game machine 2. If the CPU 33 judged that the cumulative throw-in number does not reach 80% or more of the upper limit value, the game machine 2 returns the processing to step S105, and performs processing for adding the number of throw-in game media (corresponding to medals in this preferred embodiment). On the other hand, if judged that it reaches the 80% or more, the game machine 2 does not display the amount insufficient for upper limit (step S107). This non-display of the amount insufficient for upper limit is executed under a program stored in the ROM 36, based on an instruction of the CPU 33. As the result, the display status of the gap to the upper limit on the display part 19 of the game machine 2 is changed to the non-display status.

In the case that no card is detected in step S101, the upper limit value is also not displayed (step S108).

By executing the foregoing processing, in the absence of player performing a game on a certain game machine, there moves to the state of displaying no information about a gap to the upper limit on this game machine. It is therefore avoidable that a certain player who is going to perform a game on this game machine decides to start a game by checking the upper limit value displayed on the game machine.

11. Operations and Effects

The foregoing preferred embodiment produces mainly the following operations and effects.

(1) In the collective control of plural game machines placed in the same parlor, each game machine detects player change and the credit cumulative consumption on each game machine is managed player by player. Therefore, when the credit cumulative consumption of a certain player reaches a predetermined upper limit, payout return can be executed to this player. This ensures payout return per player, thereby permitting the player to perform a game without anxiety and also inducing the player to continue the game until payout return is executed.

(2) Display and non-display of notification about both information of: i) a predetermined upper limit value; and ii) a gap to the upper limit in each player, can be changed depending on the play status. Thereby, when the upper limit information is displayed, the player continues a game while expecting payout return to be given after reaching the upper limit. On the other hand, when no upper limit information is displayed, the player can perform a game while getting a kind of high thrill. These permit to produce high game characteristics.

(3) No upper limit information is displayed on a game machine that is not in play. It is therefore avoidable that a certain player who is going to perform a game selects a game machine by checking the upper limit value.

(4) In spite of the game machine on which the player can perform a game without anxiety, high game characteristics are maintained. It is therefore possible to solve the problem of missing customers that has occurred in the conventional game machines.

While but one embodiment of the invention has been shown and described, it will be understood that many changes and modifications may be made therein without departing from the spirit or scope of the present invention.

There are for example the followings modifications:

(1) Although the identification card is used for judging whether a game machine is in play, the above-mentioned prepaid card may be used for judging the play status. Preferably, the prepaid card stores an identification number data. Whereas in the use of a prepaid card storing no identification number data, although it is impossible to discriminate the player, if judged that a game machine is not in play according to a detection signal of the card reader, the game machine can be brought into the non-display status. If judged as being in play, the game machine can be brought into the display status.

(2) Although there has been discussed only as to whether a predetermined upper limit value should be notified, if it is possible to know a gap between the credit cumulative consumption of the player and the upper limit, the display of this gap can be switched between the display status and non-display status. As a specific means to know the above-mentioned gap, there are for example the following methods of: i) displaying both of a predetermined upper limit value and a credit cumulative consumption; and ii) displaying a gap to the upper limit by a rate of credit cumulative consumption to a predetermined upper limit (i.e., one that expresses the degree of cumulative consumption in percentage).

What is claimed is:

1. A game server for collectively controlling a plurality of game machines, each of which has a display and is brought into a status enabling starting of a game based on insertion of coins or a given credit number and executes a first payout based on a result of the game, and for directing execution of a second payout based on a cumulative value corresponding to the number of coins or the credit number bet by a player playing the game on each of the plurality of game machines having reached a predetermined upper limit, the game server comprising:

a communication interface configured for receiving information indicative of the cumulative value corresponding to a number of coins or a credit number bet by only a single player continuously playing the game on each of the plurality of game machines;

a sensor configured for detecting a player's involvement; and a CPU configured for controlling the display of the applicable game machine for switching to a display status in which information related to the predetermined upper limit is displayed on the display of the applicable game machine if the player's involvement is detected by the sensor of the applicable game machine, wherein the information related to the predetermined upper limit is information representing a gap between the cumulative value indicated in the received information associated with the applicable game machine and the predetermined upper limit associated with the applicable game machine, and the CPU directs sending of a signal to the applicable game machine for executing the second payout based on the information indicative of the cumulative value having reached the predetermined upper limit, and irrespective of the game result.

2. The game server according to claim 1, wherein the CPU also directs execution of the second payout without fail by each of the plurality of game machines for which the received information indicates that the cumulative value has reached the predetermined upper limit and based on a result of a timing determination lottery for determining timing of the payout.

3. The game server according to claim 1, wherein the CPU determines, based on the received information indicative of the cumulative value, that the cumulative value has reached the predetermined upper limit when one player playing the game on one of the plurality of game machines continues playing the game until the cumulative value has reached the predetermined upper limit on the one game machine.

4. The game server according to claim 1, wherein the CPU also directs, when the one player playing the game on the one game machine is changed to another player, sending of a signal for resetting the cumulative value on the one game machine.

5. The game server according to claim 1, wherein the CPU further directs sending of a signal to the applicable game machine for starting a calculation of the cumulative value upon receiving a signal indicative of the involvement of a player detected by the sensor provided in the applicable game machine.

6. A game machine, which is brought into a status enabling starting of a game based on insertion of coins or a given credit number, which is under collective control of a game server together with other game machines, which executes a first payout return based on a result of play of the game, and which executes a second payout in accordance with a directive from the game server based on a cumulative value corresponding to a number of coins or the credit number consumed by a player playing the game on the game machine reaching a predetermined upper limit, the game machine comprising:

a sensor configured for detecting a player's involvement in the game at the game machine;

a display configured for displaying information related to the predetermined upper limit; and a communication interface configured for:

sending information indicative of the cumulative value corresponding to the number of coins or a credit number bet by a single player continuously playing the game on the game machine to the game server, and receiving a signal from the game server for switching to a display status in which the information related to the predetermined upper limit is to be displayed if the player's involvement is detected by the sensor, wherein the information related to the predetermined upper limit is information about a gap between the predetermined upper limit and the cumulative value, and the game machine executes the second payout based on the information indicative of the cumulative value having reached a predetermined upper limit, and irrespective of the game result.

7. The game machine according to claim 6, further comprising:

a CPU for executing the second payout, wherein the communication interface is also for receiving the directive to execute the second payout from the game server without fail after the cumulative value on the game machine reaches the predetermined upper limit, wherein the received directive establishes a timing for the execution of the second payout corresponding to a result of a timing determination lottery.

8. The game machine according to claim 7, wherein the CPU is also for resetting the cumulative value on the game machine after the one player playing the game on the game machine is changed to another player.

9. The game machine according to claim 7, wherein the CPU is also for determining the cumulative value only so long as the single player continues to play the game and at least until the determined cumulative value has reached the predetermined upper limit.

10. The game machine according to claim 6 wherein the game machine starts a calculation of the cumulative value upon receiving an instruction from the game server responsive to the sent information indicative of the status.

11. A game control method for collectively controlling a plurality of game machines, each of which is brought into a status enabling starting of a game based on insertion of coins or a given credit number and executes a first payout based on the result of play of the game, and for directing execution of a second payout based on a cumulative value corresponding to a number of coins or the credit number consumed by a player playing the game on each of the plurality of game machines reaching a predetermined upper limit, the game control method comprising:

receiving information indicative of the cumulative value corresponding to the number of coins or the credit number consumed by a single player continuously playing the game on each of the plurality of game machines;

controlling a display for directing switching to a display status in which information related to a predetermined upper limit is displayed in association with the applicable game machine if the received information indicates the status of the applicable game machine as being in play; and sending a signal to the applicable game machine for executing the second payout based on the information indicative of the cumulative value having reached the predetermined upper limit, and irrespective of the game result, wherein the information related to the predetermined upper limit is information representing a gap between the cumulative value on the applicable game machine and the predetermined upper limit, and wherein the received information indicative of the status of an applicable game machine is information indicative of the involvement of a player detected by a sensor at the applicable game machine and the signal sent to the applicable game machine directs switching to the display status only if the received information indicates detection of a player's involvement in the game at the applicable game machine.

12. The game control method according to claim 11, further comprising:

sending a signal to one of the plurality of game machines directing execution of the second payout without fail after the received information indicates that the cumulative value on the one game machine has reached the predetermined upper limit; and executing a timing determination lottery for determining a timing of the execution of the second payout by the one game machine.

13. The game control method according to claim 11, further comprising:

sending the signal to the one game machine directing execution of the second payout only if one player continues playing the game on the one game machine until the cumulative value on the one game machine has reached the predetermined upper limit.

14. The game control method according to claim 11, further comprising:

resetting the cumulative value on the one game machine if the one player playing the game on the one game machine is changed to another player.

15. The game control method according to claim 11, further comprising:

sending a signal to the applicable game machine for starting a calculation of the cumulative value upon receiving the information indicative of the involvement of a player detected by the sensor at the applicable game machine.

16. A game machine, which is brought into a status enabling starting of a game based on insertion of coins or a given credit number, which is under collective control of a game server together with other game machines, which executes a first payout based on a result of play of the game, and which executes a second payout in accordance with a directive from the game server based on a cumulative value corresponding to a number of coins or a credit number bet by a player continuously playing the game on the game machine reaching a predetermined upper limit, the game machine comprising:

a display configured for displaying information related to a predetermined upper limit;

a sensor configured for detecting a player's involvement in the game at the game machine; and a communication interface configured for receiving a signal from the game server for displaying the information related to the predetermined upper limit if the player's involvement is detected by the sensor, wherein the information related to the predetermined upper limit is information about a gap between the predetermined upper limit and the cumulative value, and the game machine executes the second payout based on the information indicative of the cumulative value having reached a predetermined upper limit, and irrespective of the game result.

17. The game machine according to claim 16 wherein the game machine:

sends a signal indicative of the player's involvement detected by the sensor, and starts a calculation of the cumulative value upon receiving an instruction from the game server responsive to the sent information indicative of the status.

* * * * *